US007585111B2

(12) United States Patent
Turvey et al.

(10) Patent No.: US 7,585,111 B2
(45) Date of Patent: Sep. 8, 2009

(54) RECLOSABLE POUCH AND CLOSURE ELEMENT THEREFOR HAVING INTERLOCKING CLOSURE PROFILES

(75) Inventors: Robert R. Turvey, Sanford, MI (US); Bryan L. Ackerman, Freeland, MI (US); James C. Pawloski, Bay City, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 682 days.

(21) Appl. No.: 11/047,013

(22) Filed: Jan. 31, 2005

(65) Prior Publication Data

US 2006/0171609 A1 Aug. 3, 2006

(51) Int. Cl.
*B65D 33/16* (2006.01)

(52) U.S. Cl. ..... 383/63; 383/61.2; 383/65

(58) Field of Classification Search ..... 383/61.2, 383/61.3, 63, 65

See application file for complete search history.

(56) References Cited

U.S. PATENT DOCUMENTS

| | | | | | |
|---|---|---|---|---|---|
| 2,499,898 | A | | 3/1950 | Anderson | 24/206 |
| 2,715,759 | A | | 8/1955 | Poux | 24/20 |
| 2,791,807 | A | | 5/1957 | Morin | 18/59 |
| 2,886,085 | A | | 5/1959 | Sanger | 150/1.6 |
| 2,994,117 | A | | 8/1961 | McMullin | 24/201 |
| 3,325,084 | A | * | 6/1967 | Ausnit | 229/77 |
| 3,338,285 | A | | 8/1967 | Jaster | 150/3 |
| 3,343,233 | A | | 9/1967 | Gould | 24/400 |
| 3,462,332 | A | | 8/1969 | Goto | 156/244 |
| 3,557,413 | A | | 1/1971 | Engle | 24/201 |
| 3,608,439 | A | | 9/1971 | Ausnit | 93/35 R |
| 3,679,511 | A | | 7/1972 | Ausnit | 156/251 |
| 3,679,531 | A | | 7/1972 | Wienand et al. | 161/48 |
| 3,808,648 | A | | 5/1974 | Billarant et al. | 24/204 |
| 4,187,068 | A | | 2/1980 | Vassar | 425/381 |
| 4,212,337 | A | | 7/1980 | Kamp | 150/3 |
| 4,256,685 | A | | 3/1981 | Vassar | 264/167 |
| 4,419,159 | A | | 12/1983 | Herrington | 156/66 |
| 4,430,070 | A | | 2/1984 | Ausnit | 493/215 |
| 4,484,352 | A | * | 11/1984 | Katzin | 383/65 |
| 4,522,678 | A | | 6/1985 | Zieke | 156/501 |
| 4,540,537 | A | | 9/1985 | Kamp | 264/171 |
| 4,603,434 | A | | 7/1986 | Herrington | 383/95 |
| 4,665,557 | A | | 5/1987 | Kamp | 383/63 |
| 4,701,358 | A | | 10/1987 | Behr et al. | 428/35 |
| 4,755,248 | A | | 7/1988 | Geiger et al. | 156/244.25 |
| 4,787,880 | A | | 11/1988 | Ausnit | 493/213 |

(Continued)

FOREIGN PATENT DOCUMENTS

| | | |
|---|---|---|
| JP | U 2-15437 | 1/1990 |

*Primary Examiner*—Nathan J Newhouse
*Assistant Examiner*—Jack H Morgan, Jr.

(57) ABSTRACT

A reclosable pouch includes interlocking male and female closure elements having elongate hollow closure profiles. The male closure profile has a hollow shaft section, and the female closure profile has a channel with at least one hollow side. Alternatively, a set of hollow male closure profiles may also form one or more female closure profiles therebetween. A set of pleated grip strips may be disposed adjacent the closure elements to aid in opening a pouch. The closure elements and grip strips may be integral with pouch sidewalls, may be secured and/or separately extruded on to, for example, a polymer, directly to pouch sidewalls, or may be secured to backing strips to form a closure strip, which may subsequently be secured to pouch sidewalls.

20 Claims, 12 Drawing Sheets

U.S. PATENT DOCUMENTS

| | | | | |
|---|---|---|---|---|
| 4,812,056 | A | 3/1989 | Zieke | 383/65 |
| 4,829,641 | A | 5/1989 | Williams | 24/587 |
| 4,929,225 | A | 5/1990 | Ausnit et al. | 493/213 |
| 4,929,487 | A | 5/1990 | Tilman et al. | 428/163 |
| 5,088,162 | A | 2/1992 | Allan | 24/442 |
| 5,088,164 | A | 2/1992 | Wilson et al. | 24/584.1 |
| 5,097,570 | A | 3/1992 | Gershenson | 24/452 |
| 5,113,555 | A | 5/1992 | Wilson et al. | 24/576 |
| 5,172,980 | A | 12/1992 | Provost | 383/204 |
| 5,179,767 | A | 1/1993 | Allan | 24/442 |
| 5,189,765 | A | 3/1993 | Singhal | 24/400 |
| 5,209,574 | A | 5/1993 | Tilman | 383/63 |
| 5,211,481 | A | 5/1993 | Tilman | 383/63 |
| 5,216,787 | A | 6/1993 | Custer et al. | 24/587 |
| 5,219,588 | A | 6/1993 | England et al. | 425/189 |
| 5,242,646 | A | 9/1993 | Torigoe et al. | 264/219 |
| 5,259,904 | A | 11/1993 | Ausnit | 156/244.15 |
| 5,293,672 | A | 3/1994 | Tominaga et al. | 24/587 |
| 5,343,659 | A | 9/1994 | Zaleski | 52/24 |
| 5,369,847 | A | 12/1994 | Naya et al. | 24/30.5 R |
| 5,371,925 | A | 12/1994 | Sawatsky | 24/30.5 R |
| 5,384,942 | A | 1/1995 | Siegel | 24/587 |
| 5,403,094 | A | 4/1995 | Tomic | 383/63 |
| 5,480,030 | A | 1/1996 | Sweeny et al. | 206/524.8 |
| 5,509,734 | A | 4/1996 | Ausnit | 383/63 |
| 5,527,112 | A | 6/1996 | Dais et al. | 383/211 |
| 5,614,232 | A | 3/1997 | Torigoe et al. | 425/545 |
| 5,747,126 | A | 5/1998 | Van Erden et al. | 428/35.2 |
| 5,797,170 | A * | 8/1998 | Akeno | 24/452 |
| 5,890,810 | A | 4/1999 | Barlow | 383/120 |
| 5,933,927 | A | 8/1999 | Miller et al. | 24/452 |
| 5,944,425 | A | 8/1999 | Forman | 383/61 |
| 5,988,492 | A | 11/1999 | Capy et al. | 229/122.34 |
| 6,080,252 | A | 6/2000 | Plourde | 156/66 |
| 6,082,897 | A | 7/2000 | Galomb | 383/63 |
| 6,138,329 | A | 10/2000 | Johnson | 24/587 |
| 6,154,934 | A | 12/2000 | Matthews | 24/587 |
| 6,167,597 | B1 * | 1/2001 | Malin | 24/585.1 |
| 6,185,796 | B1 | 2/2001 | Ausnit | 24/587 |
| 6,217,215 | B1 * | 4/2001 | Tomic | 383/63 |
| 6,299,353 | B1 * | 10/2001 | Piechocki et al. | 383/63 |
| 6,367,976 | B1 | 4/2002 | Bannister | 383/85 |
| 6,371,644 | B1 * | 4/2002 | Forman | 383/63 |
| 6,519,918 | B2 | 2/2003 | Forman et al. | 53/412 |
| 6,789,946 | B2 | 9/2004 | Plourde et al. | 383/63 |
| 2002/0168118 | A1 | 11/2002 | Price | 383/64 |
| 2003/0219174 | A1 * | 11/2003 | Piechocki | 383/59 |
| 2004/0001650 | A1 | 1/2004 | Piechocki et al. | 383/59 |
| 2004/0013323 | A1 | 1/2004 | Withers | 383/63 |
| 2004/0052434 | A1 | 3/2004 | Bell | 383/35 |
| 2004/0058103 | A1 | 3/2004 | Anderson et al. | 428/34.1 |
| 2004/0066988 | A1 | 4/2004 | Yi Li | 383/120 |
| 2004/0136618 | A1 | 7/2004 | Ausnit et al. | 383/64 |
| 2004/0252915 | A1 | 12/2004 | Nelson | |

* cited by examiner

RECLOSABLE POUCH AND CLOSURE ELEMENT THEREFOR HAVING INTERLOCKING CLOSURE PROFILES

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates to a reclosable pouch and a closure mechanism therefor.

2. Description of the Background of the Invention

A reclosable pouch for storage of items typically includes a closure mechanism disposed at, or adjacent to, a mouth of the pouch. Frequently, the closure mechanism for a reclosable pouch includes an extruded male closure element disposed on one sidewall of the reclosable pouch that interlocks with a complementary extruded female closure element disposed on an opposite sidewall of the reclosable pouch. In many cases, the male closure element has an elongate solid core arrow-shaped male closure profile, and the female closure element has an elongate solid core channel-shaped female closure profile.

In other cases, a portion of the male or closure profile has a hollow portion. For example, one elongate extruded male closure profile has a hollow circular head portion disposed on a solid shaft portion. Another elongate extruded hollow male closure profile has a hollow circular or trapezoidal interlocking portion that is disposed directly on a backing member. Yet another male closure assembly includes an array of non-elongate arrow-shaped male closure elements, each of which has a barbed head portion disposed on a hollow cylindrical shaft portion.

One closure mechanism includes a first non-extruded elongate arrow-shaped closure profile that fits interlockingly within a hollow core of a second non-extruded larger elongate hollow arrow-shaped closure profile. Both the first and second closure profiles have an opening into a base of a hollow shaft portion and a hollow head portion. The first closure profile extends into the opening in the base of the second closure profile and nests within the hollow shaft and head thereof. Each closure profile has a multi-layer portion of a sidewall that is formed by either folding and overlapping a portion of a pouch sidewall or laminating a separate strip onto a pouch sidewall and then crimping or stamping the multi-layer portion into the arrow shape.

Yet another type of closure mechanism includes elongate interlocking tongue and groove profile strips that can be clamped together on opposite sides of a bag or pouch to seal the sidewalls of the bag or pouch therebetween. Such tongue and groove profile strips may be secured to or separate from an outer surface of each sidewall of the bag or pouch. In one example, the tongue profile strip has a hollow bulbous tongue portion that snap-fits into the groove profile strip.

Other non-interlocking portions of a closure element also may have a hollow profile. For example, some closure elements have elongate hollow circular bumper ridge or seal bead profiles disposed adjacent to a male and/or female closure profile. Other closure elements include an elongate hollow circular bumper ridge disposed inside an elongate channel-shaped female closure profile.

Grip ridges may also be disposed on a sidewall of a reclosable pouch adjacent to the closure profiles to provide increased traction for a user trying to open and/or close the closure profiles. The grip ridges are often disposed on a surface of a backing member or the sidewall of the reclosable pouch such that a cross-sectional profile of the pouch is thicker at the grip ridge, including a thickness of both the grip ridge and the backing member, than at an adjacent portion of the pouch including a thickness of only the backing member.

SUMMARY OF THE INVENTION

In accordance with one aspect of the present invention, a reclosable pouch includes opposing first and second sidewalls defining a mouth of the pouch, a first closure element disposed along the first sidewall adjacent the mouth and having a first elongate male interlocking profile, and a second closure element disposed along the second sidewall opposite the first closure element and having second and third elongate male interlocking profiles. Each male interlocking profile includes a male interlocking member disposed on a hollow shaft. The second and third male interlocking profiles further define an elongate female interlocking profile therebetween such that the first male profile releasably interlocks into the female interlocking profile.

In accordance with another aspect of the present invention, a closure strip includes a plurality of spaced male closure elements. Each male closure element has an elongate male interlocking profile including a male interlocking member disposed proximate an end of a shaft having a hollow core. A pair of adjacent male closure elements defines a substantially complementary elongate female closure element therebetween.

In accordance with yet another aspect of the present invention, an elongate closure profile includes a first male interlocking profile adjacent to a second male interlocking profile. Each male interlocking profile includes a first shaft wall spaced from a second shaft wall and a male interlocking member disposed across a distal end of the shaft walls. The first male interlocking profile and the second male interlocking profile define a female interlocking profile therebetween configured to interlockingly accept an opposing interlocking profile.

DETAILED DESCRIPTION

The present invention is directed toward apparatuses, methods, kits, and combinations for opening and/or closing a reclosable pouch. While the present invention may be embodied in many different forms, several specific embodiments are discussed herein with the understanding that the present disclosure is to be considered only as an exemplification of the invention and is not intended to limit the invention to the embodiments illustrated. For example, where the invention is illustrated herein with particular reference to a reclosable thermoplastic pouch, it will be understood that any other pouch, such as a bag (for example a paper, plastic, or foil bag, a handbag, a shopping bag, or a shoulder or duffle bag), a sack (for example, a carrier or courier sack), a purse, a pocketbook, a suitcase, or the like can, if desired, be substituted in whole or in part for the reclosable pouch in the apparatuses, methods, kits, and combinations herein described.

It has been discovered that the closure assemblies described herein are unique assemblies exhibiting improved performance as closure mechanisms. Such closure assemblies exhibit improved functioning as closure assembly mechanisms including, for example, improved opening and/or closing of a reclosable pouch, retaining the closure assembly in an open and/or closed position, and/or improved tactile feel to a user. The closure assemblies of the present invention also exhibit improved ease of use, and/or reduce or minimize an amount of material required to produce a closure assembly.

Figure 1:
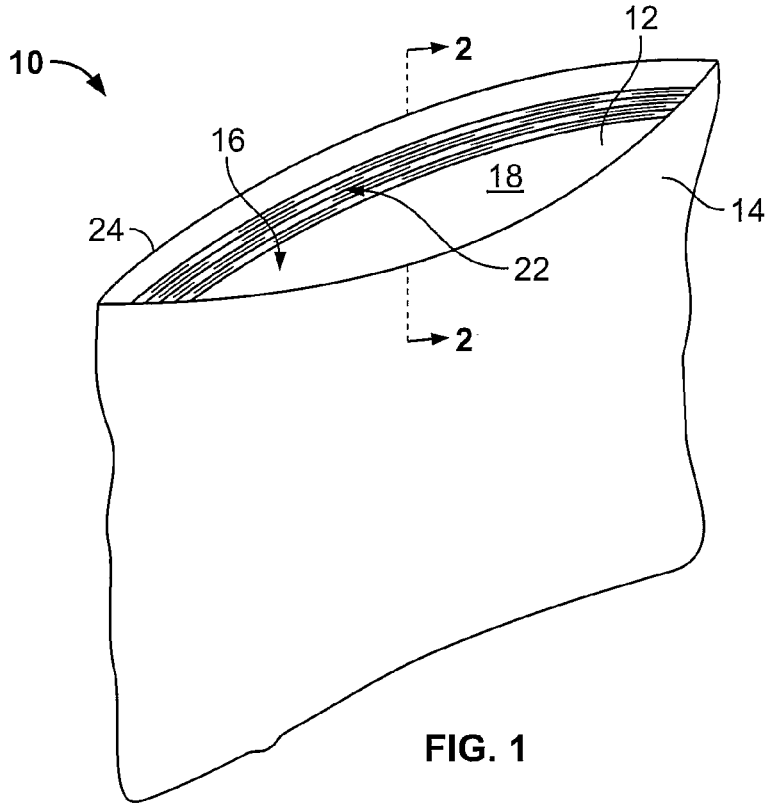
FIG. 1 is an isometric view of a reclosable pouch including hollow core closure elements according to one embodiment of the present invention.

Turning now to FIG. 1, a reclosable pouch 10 includes first and second opposing pouch sidewalls 12, 14 that define a mouth or opening 16 into an interior space 18 of the reclosable pouch. A closure mechanism for opening and closing the mouth 16 of the reclosable pouch 10 includes a male closure element 20 and a female closure element 22 opposingly disposed along the pouch sidewalls 12, 14 generally coextensive with a mouth edge 24 of the pouch sidewalls to selectively interlockingly engage and disengage with each other. One or more gripping ridges 25 or other surface irregularities or gripping assists are located along the sidewalls 12, 14 between male closure element 20 and female closure element 22 and the adjacent mouth edge 24 to provide increased gripping traction for a user trying to open or close the mouth 16.

Figure 2A:
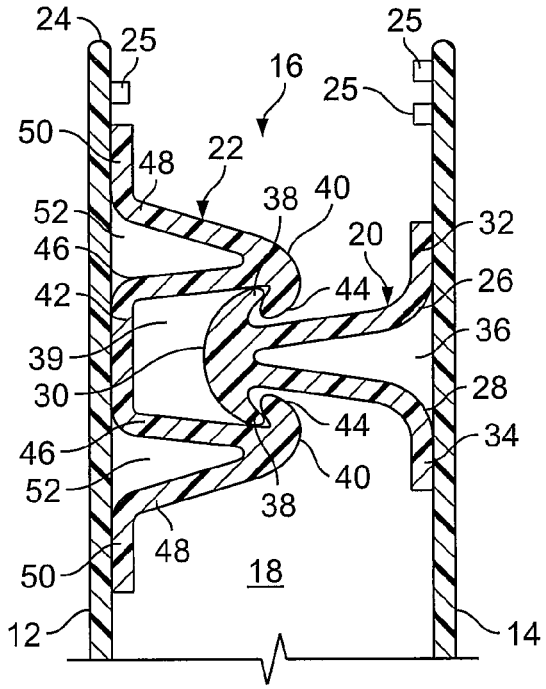
FIG. 2A is a fragmentary, enlarged cross-sectional view taken generally along the lines 2-2 of FIG. 1 with portions behind the plane of the cross-section omitted for purposes of clarity and the closure elements fully interlocked.

As seen in FIG. 2A, a male closure element 20 has an elongate interlocking profile including a shaft defined by a pair of opposing spaced apart shaft walls 26, 28 extended outwardly from a pouch sidewall 14, a head wall 30 spanning across distal ends of the shaft walls opposite the pouch sidewall, and flanges 32, 34 extending laterally outwardly from base ends of the shaft walls along the pouch sidewall. The shaft walls 26, 28 converge at or near the head wall 30 and, with the pouch sidewall 14, define and enclose a hollow shaft core 36. The head wall 30 protrudes laterally past the shaft walls 26, 28 to define male interlocking members, such as hooks or barbs 38, on opposite sides of the shaft. The barbs 38 may be symmetrical or asymmetrical about the shaft walls 26, 28, depending on the application in which the barbs are utilized. Other forms of interlocking members may also be used, such as, for example, enlarged or bulbous head portions, arrow-shaped heads, and/or other various shaped projections suitable for forming an interlocking fit with a complementary female interlocking member.

A female closure element 22 has an elongate interlocking profile substantially complementary to the profile of the male closure element 20 and includes a channel 39 defined by a pair of opposed channel walls or sides 40 that are hollow, a bottom wall 42, and a female interlocking members, such as pair of in-turned hooks or barbs 44, for interlocking engagement with the barbs 38 of the male closure element 20. Each channel side 40 further includes an interior or inner wall 46 spaced from an exterior or outer wall 48 and a bottom flange 50 extending laterally outwardly from a base end of the outer wall. The inner wall 46 and the outer wall 48 converge together at or near a distal end of the profile and are spaced from each other at the pouch sidewall end of the profile so that the inner wall 46 is independently attached to the pouch sidewall 12 at a predetermined distance from the outer wall 48. The bottom wall 42 and each flange 50 are substantially coplanar and are attached to the pouch sidewall 12. The inner wall 46, outer wall 48, and pouch sidewall 12 define a hollow core 52 inside each channel side 40. The hollow core 52 in one embodiment may extend an entire elongate length of the female closure element 22, or the hollow core may be interrupted by sections of material at intermediate locations between ends of the female closure element. In another embodiment (not shown), a channel 39 may have any number of walls to define any number of shapes and/or configurations so long as the channel can be configured to interlock and/or engage a male interlocking member. Illustratively, the channel 39 may be bowl-shaped, U-shaped, V-shaped, W-shaped, and/or concave shaped, and combinations thereof.

The profile of the male closure element 20 is received within the profile of the female closure element 22 with the barbs 38 interlockingly engaging the hooks 44 to seal or close the pouch sidewalls 12, 14 together at a mouth 16. A user may alternatingly engage and disengage the male closure element 20 and the female closure element 22 by pressing the closure elements together as shown in FIG. 2A and pulling the closure elements apart. Gripping ridges 25 disposed between a mouth edge 24 of the reclosable pouch 10 and each of the male closure element 20 and the female closure element 22 provide traction for the fingers of the user while opening and/or closing the reclosable pouch.

Figure 2B:
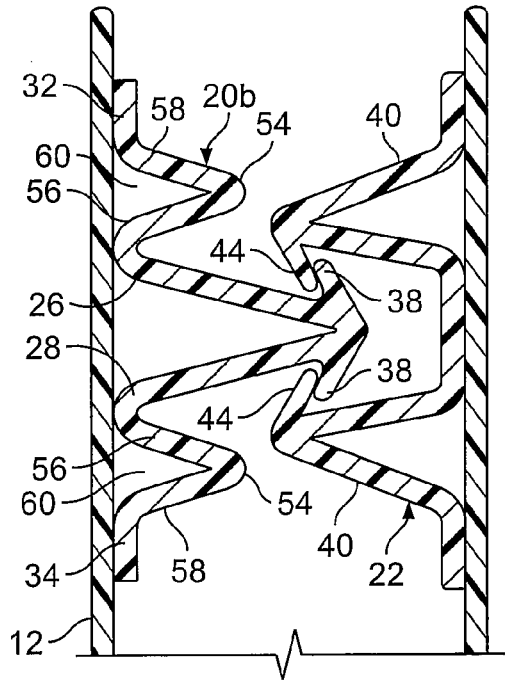
FIG. 2B is a fragmentary, enlarged cross-sectional view taken generally along the lines 2-2 of FIG. 1 with portions behind the plane of the cross-section omitted for purposes of clarity and with a pair of closure elements according to another embodiment of the present invention fully interlocked.

In FIG. 2B, another male closure element 20*b* is shown having a hollow shaft core 36 and a head wall 30 similar to the male closure element 20 of FIG. 2A, and also includes a pair of hollow ridges or bumper ribs 54 on opposite base sides of the shaft. Each bumper rib 54 includes an inner wall 56 extended angularly upwardly from a base end of an adjacent shaft wall and an outer wall 58 extended angularly downwardly from an apex of the inner wall. The apex in this embodiment is shorter than or disposed below the shaft walls 26, 28. Each bumper rib 54 is disposed between one of the shaft walls 26, 28 and adjacent flanges 32, 34. The inner wall 56 and the outer rib wall 58 of each rib 54 and a pouch sidewall 12 together define a hollow core 60. Each bumper rib 54 may act as a bumper or cushion for an opposing barb end of a female channel side 40 to prevent crushing of the male shaft walls 26, 28 when the male closure element 20 is engaged within a female closure element 22. The bumper ribs 54 may also help keep female channel hooks 44 engaged to male head barbs 38 by urging the channel sides 40 inwardly toward the shaft walls 26, 28. The hollow cores 60 of each bumper rib 54 may also provide a wider and softer tactile sensation to a user and in some instances require less material than a similarly sized solid core bumper rib.

Figure 2C:
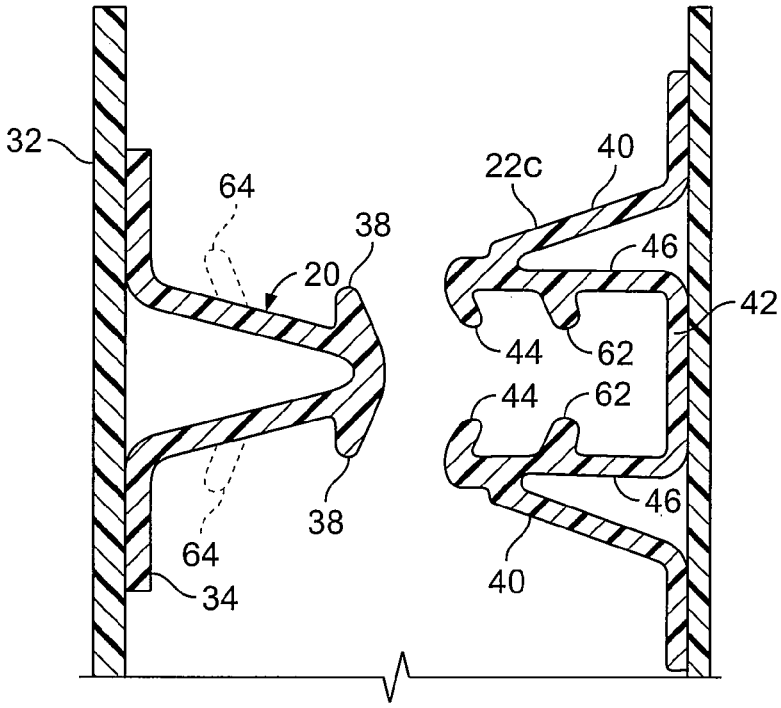
FIG. 2C is a fragmentary, enlarged cross-sectional view taken generally along the lines 2-2 of FIG. 1 with portions behind the plane of the cross-section omitted for purposes of clarity and with a pair of closure elements according to yet another embodiment of the present invention occluded.

In FIG. 2C, yet another female closure element 22*c* is shown having a channel profile with hollow channel sides 40 similar to the female closure element 22 in FIG. 2A, and also includes a second set of in-turned hooks 62 spaced along inner channel sidewalls 46 between hooks 44 and a bottom wall 42. In another embodiment, the second hooks 62 may be disposed directly adjacent to the hooks 44. The second hooks 62 provide an additional seal and interlocking mechanism between a male closure element 20*c* and the female closure element 22*c* to decrease the possibility of unwanted disengagement of the male closure element from the female closure element. In another embodiment, a second set of barbs 64 (shown in dotted lines) may extend outwardly from an exterior surface of each shaft wall 28 and 30 between barbs 38 and flanges 32, 34 to provide a second interlocking mechanism between the male closure element 20*c* and the female closure elements 22*c*. The barbs 38 engage hooks 62 and the barbs 64 engage hooks 44 when the male closure element 20*c* is fully interlocked with the female closure element 22*c*.

Figure 2D:
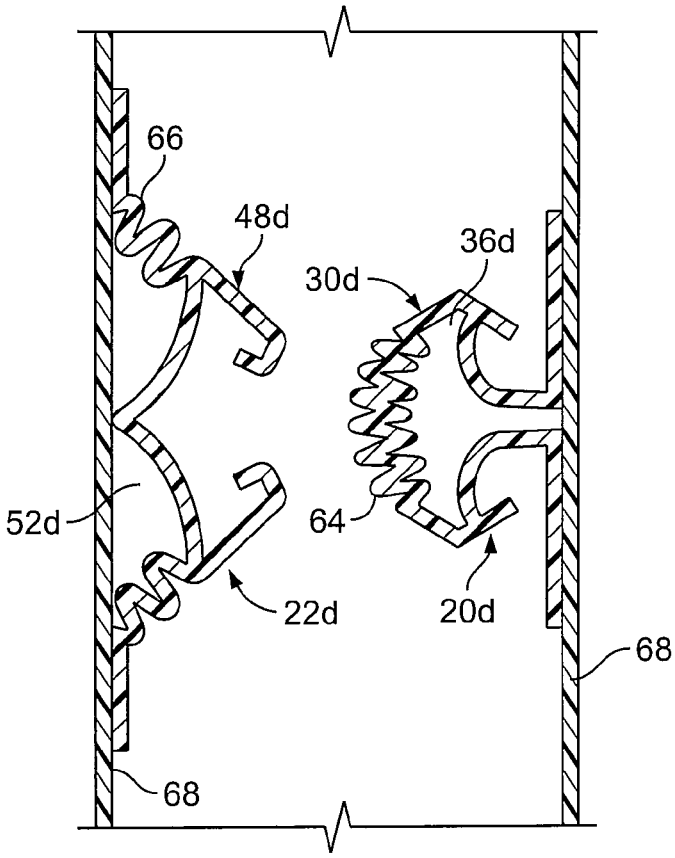
FIG. 2D is a fragmentary, enlarged cross-sectional view taken generally along the lines 2-2 of FIG. 1 with portions behind the plane of the cross-section omitted for purposes of clarity and with a pair of closure elements according to a further embodiment of the present invention fully disengaged.

In FIG. 2D, another set of elongate profiles for a male closure element 20*d* and a female closure elements 22*d* is shown. The male closure element 20*d* includes a hollow elongate male profile having a head wall 30*d* with pleats 64 therein and a hollow shaft core 36*d*. The female closure element 22*d* includes an elongate female channel profile having hollow cores 52*d* defined between an inner wall 46*d* and an outer wall 48*d*. Each outer channel wall 48*d* has a plurality of pleats 66 formed therein. The pleats 66 in the outer walls 48 provide a springy tactile sensation to the user and provide increased deflection of the profiles when interlocking and unlocking opposing closure elements 20*d* and 22*d*. Each of the male closure element 20*d* and the female closure element 22*d* may be secured and/or separately extruded on to, for example, a like polymer to any backing member 68 such as directly to a pouch sidewall or to an intermediate backing strip.

Figure 3:
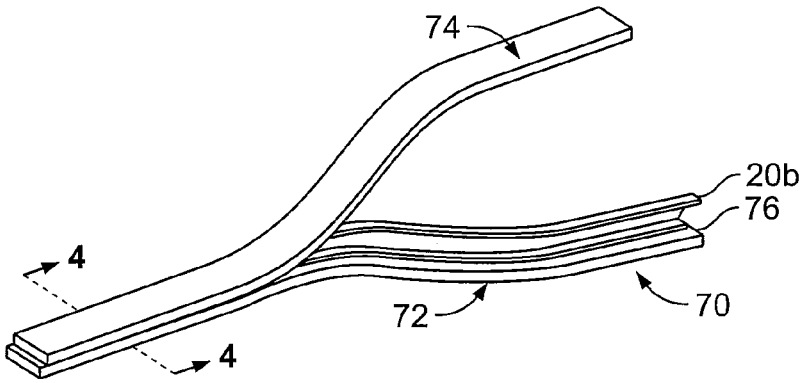
FIG. 3 is a fragmentary isometric view of a portion of a closure strip including hollow core closure elements according to an additional aspect of the present invention.
Figure 4:
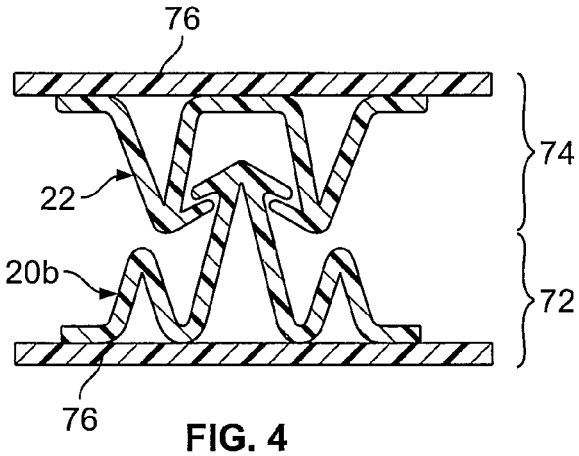
FIG. 4 is an enlarged cross-sectional view taken generally along the lines 4-4 of FIG. 3 with portions behind the plane of the cross-section omitted for purposes of clarity.
Figure 5:
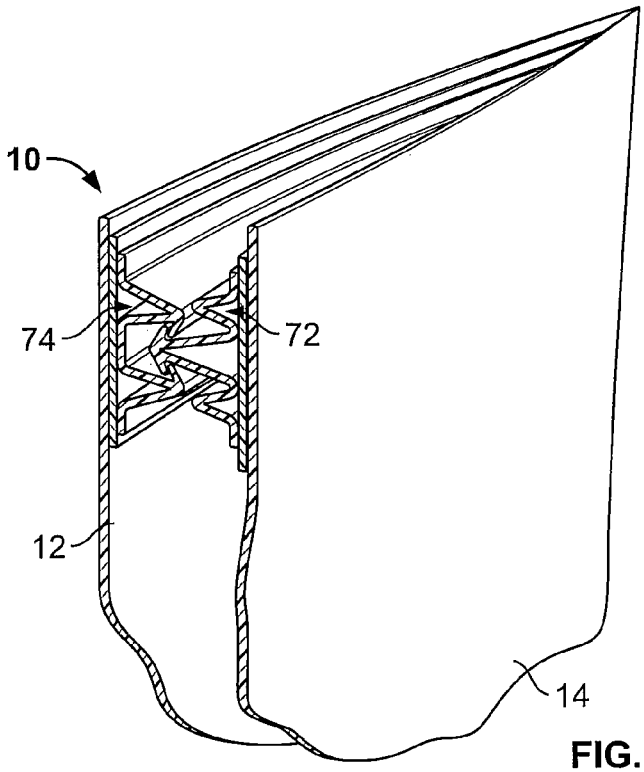
FIG. 5 is a fragmentary isometric view with portions removed of a reclosable pouch according to another aspect of the present invention and including the closure strip of FIG. 3.

In FIGS. 3 and 4, a closure strip 70 includes a male closure member 72 that engages or interlocks with a female closure member 74. The male closure member 72 and the female closure member 74 are suitable for securement to opposing pouch sidewalls 12, 14 as shown in FIG. 5 to form a reclosable pouch 10. The male closure member 72 includes the hollow core male closure element 20*b* of FIG. 2B having a backing strip 76 disposed across a base end thereof to define an enclosed hollow shaft core 36 and enclosed hollow bumper ribs 54. The female closure member 74 includes the hollow core female closure element 22 of FIG. 2A having another backing strip 76 disposed across a base end thereof to define enclosed hollow channel sides 40. The backing strips 76 are attached to opposing inner surfaces of the pouch sidewalls 12, 14 such that the male closure element 20*b* opposes the female closure element 22 to facilitate interlocking engagement thereto. The male closure member 72 and the female closure member 74 may alternatively include any of the hollow core closure elements disclosed herein or any other closure element adapted to interlockingly engage with closure elements similar to the hollow core closure elements disclosed herein. The backing strips 76 may be formed of extruded thermoplastic or other materials, such as, for example, cloth, paper, cardboard, or rubber, and combinations thereof.

The hollow core male and female closure elements 20 and 22, and the various embodiments disclosed herein, may cause such closure elements to have a wider and softer tactile sensation to a user than similarly sized solid core closure elements. The hollow core male and female closure elements 20 and 22 also generally require less material than similarly sized solid core closure elements and can be extruded at higher rates of speed than similarly sized solid core closure elements.

Figure 6:
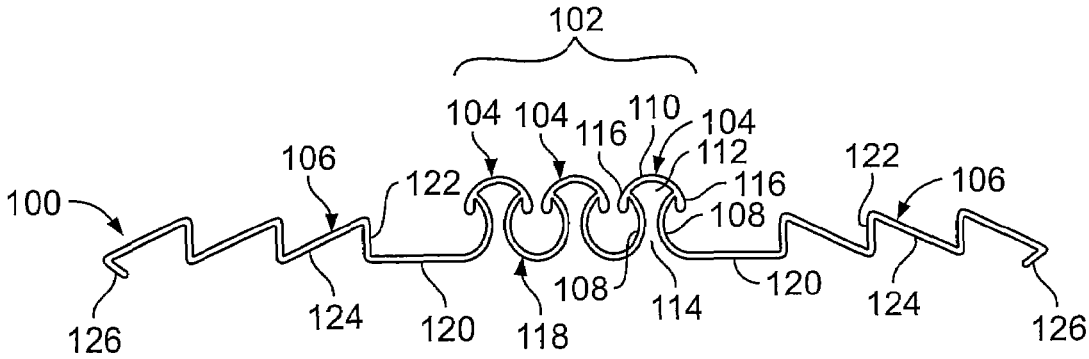
FIG. 6 is a cross-sectional view of a closure strip according to another aspect of the present invention having hollow interlocking profiles and pleated grip ridges.

Turning now to FIG. 6, a closure strip 100 for sealing or closing a mouth of a reclosable pouch or other container includes a male/female profile set 102 of repeating elongate hollow core male interlocking profiles 104 disposed between sets of pleated grip ridges profiles 106. Each male interlocking profile 104 includes a pair of spaced apart arcuate shaft walls 108 and a head wall 110 spanning a top end of the shaft walls that define a hollow core 112 and an opening 114 into the hollow core. The shaft walls 108 in each male interlocking profile 104 are bowed or converge inwardly toward each other, and the head wall 110 is arched outwardly from the hollow core 112. The male interlocking profiles 104 may use less material and provide a softer and stretchier tactile feel than similarly sized solid core profiles. The head wall 110 overhangs laterally beyond the shaft walls 108 to define interlocking members, such as hooks 116. Adjacent male interlocking profiles 104 define a female interlocking channel 118 therebetween. The female interlocking channel 118 is configured or sized to engage or accept therein an opposing male interlocking profile (not shown) similar to or the same as the male interlocking profiles 104 such that the hooks 116 may interlock with similar hooks on the opposing male interlocking profile.

The pleated grip ridge profiles 106 are formed in flanges 120 extending laterally outwardly from each opposite end of the male/female profile set 102. Each grip ridge profile 106 has an asymmetrical saw tooth shape including a first portion 122 disposed substantially orthogonally to the flange 120 and a second portion 124 that is angled toward the closure element. The asymmetrical saw tooth shape of the grip ridge profile 106 provides more aggressive gripping traction directed away from the male/female profile set 102 than in the opposite direction in order to provide additional gripping traction when opening the interlocking profiles 104. However, any other ridge profile shape having a first portion and a second portion angularly disposed from the first portion could be used, such as rectangular shapes, wave shapes, circular shapes, and/or polygonal shapes, and combinations thereof (not shown). A hook 126 disposed along an outer end of each set of grip ridge profiles 106 is angled toward the interlocking profiles 104 to provide additional gripping structure and to make it easier for a user to isolate the edge of the closure strip 100 when trying to open interlocked closure strips 100. In some embodiments, all sections of the closure strip profile may have substantially the same thickness, or in other embodiments some sections of the closure strip profile may be thicker than other sections for structural and/or aesthetic reasons.

In one embodiment, the closure strip 100 is an extruded polymeric material having a symmetrical overall profile for ease of manufacture and to prevent unbalanced shrinking or necking of the closure strip during extrusion. The entire closure strip 100 may be applied directly to a pouch sidewall (not shown). Alternatively, the closure strip 100 may be prepared for application to a pouch sidewall 130 by trimming one set of ridges 106*a* off of the closure strip as indicated by dashed lines in FIG. 7 to form an asymmetrical closure strip 100*a* having a male female profile set 102 of interlocking profiles 104, flanges 120*a*, 120*b*, a single set 106*b* of grip ridges 106, and a single hook 126. In another alternative, the asymmetrical closure strip 100*a* may be extruded directly to include grip ridges 106 and a hook 126 on only one side of the male/female profile set 102 of interlocking profiles 104, as shown in FIG. 8. The closure strip 100*a* may then be post-applied to a pouch sidewall 130 or other backing member as shown in FIGS. 7 and 8.

Figure 7:
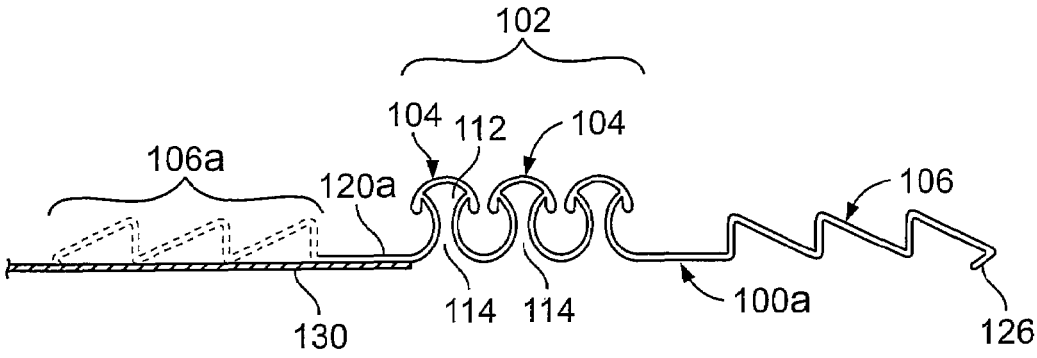
FIG. 7 is a fragmentary cross-sectional view of a the closure strip of FIG. 6 applied to a backing member in a first configuration according to a further aspect of the present invention.
Figure 8:
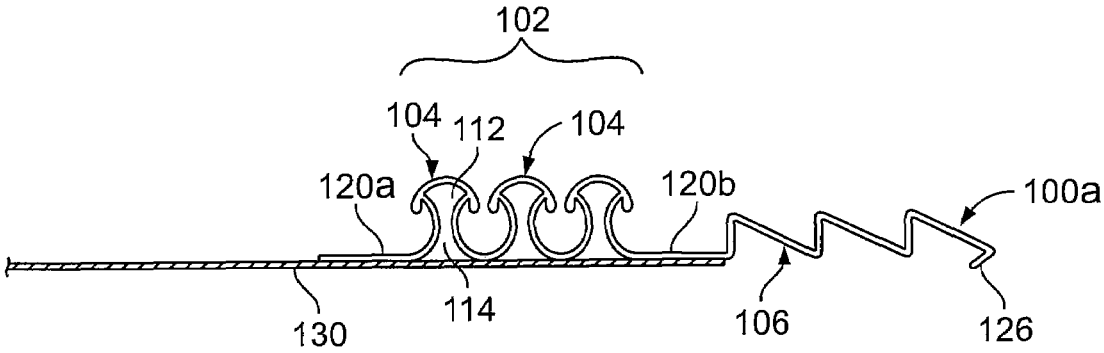
FIG. 8 is a fragmentary cross-sectional view of the closure strip of FIG. 6 applied to a backing member in a second configuration according to yet another aspect of the present invention.

In one embodiment shown in FIG. 7, only the flange portion 120*a* is attached to the pouch sidewall 130, thereby leaving openings 114 into hollow cores 112 of the interlocking profiles 104 open and the grip ridges 106 without a backing. In another embodiment shown in FIG. 8, the pouch sidewall 130 is attached to both of flange portions 120*a* and 120*b* and covers openings 114 into hollow cores 112 of the closure elements 104, thereby forming a closure element having an enclosed hollow core. The pouch sidewall 130 does not extend behind the grip ridges 106 so that the grip ridges may provide a ribbed tactile sensation to a user on both sides thereof, and/or so the ridges may have increased stretchiness. Alternatively, the pouch sidewall 130 may be secured behind the grip ridges 106 in order to reduce any stretchiness of the closure strip 100*a*. A second closure strip (not shown) including similar pleated grip ridges may be attached to a second pouch sidewall (not shown) opposite the first closure strip in order to provide a high level of gripping traction for both pouch walls. The grip ridges on the second closure strip may be mirror images of the grip ridges 106 on the closure strip 100*a* so that the grip ridges do not mate against each other, or the opposing grip ridges may be complementary so that they do mate against each other. The closure strips 100 or 100*a* may alternatively be extruded or otherwise formed directly as part of the pouch sidewalls (not shown), in which case the entire closure strip may have substantially the same thickness as adjoining portions of the surrounding bag wall.

Figure 9:
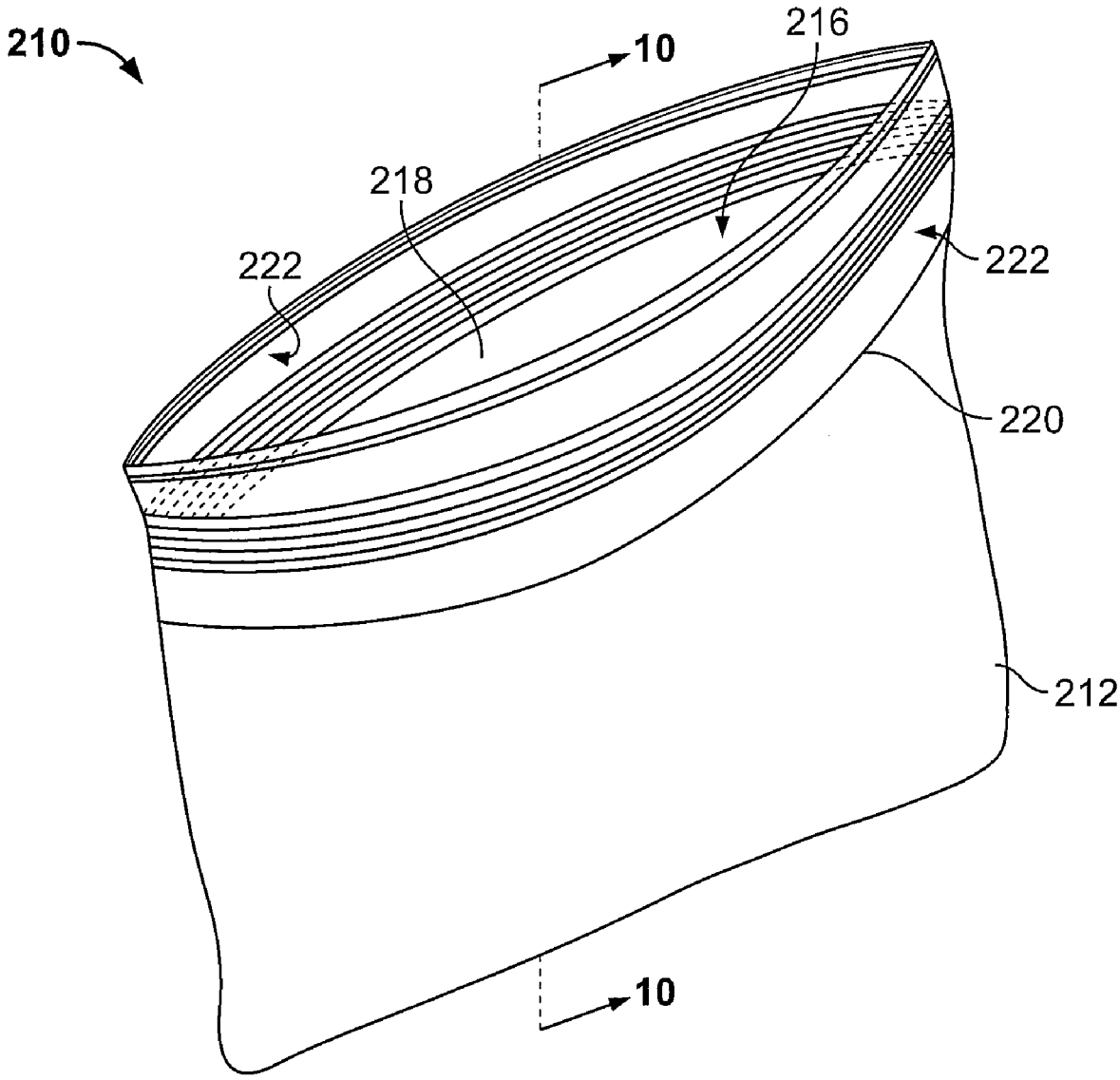
FIG. 9 is an isometric view of a reclosable pouch having hollow interlocking profiles according to an additional aspect of the present invention.
Figure 10A:
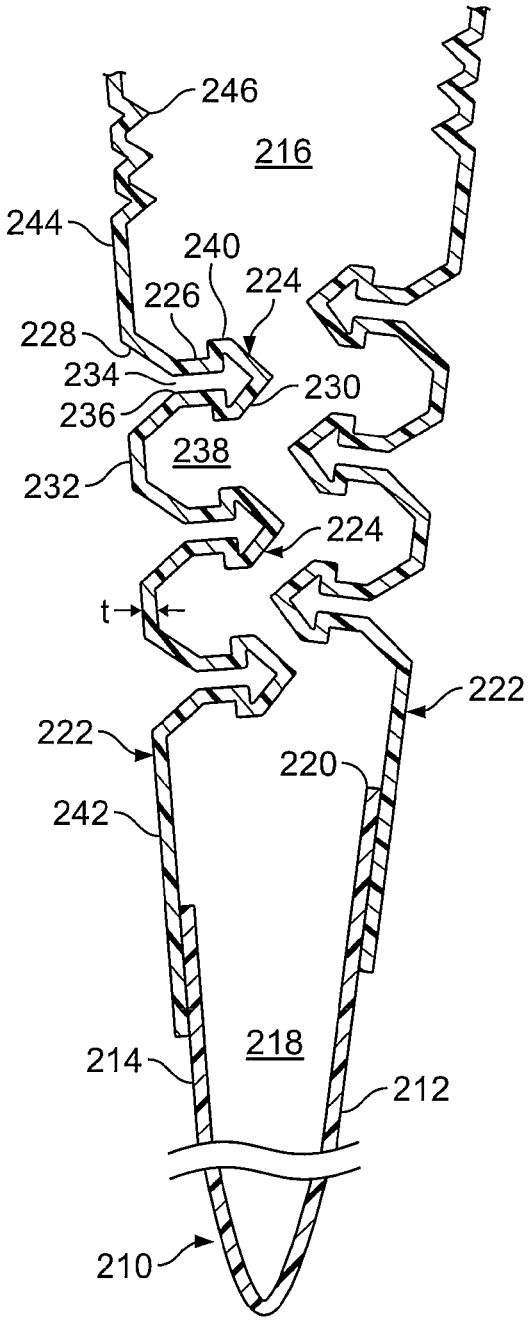
FIGS. 10A and 10B are fragmentary cross-sectional views taken generally along the lines 10-10 of FIG. 9 showing the reclosable pouch in an open position and occluded, respectively, with portions behind the plane of the cross-section omitted for purposes of clarity.
Figure 10B:
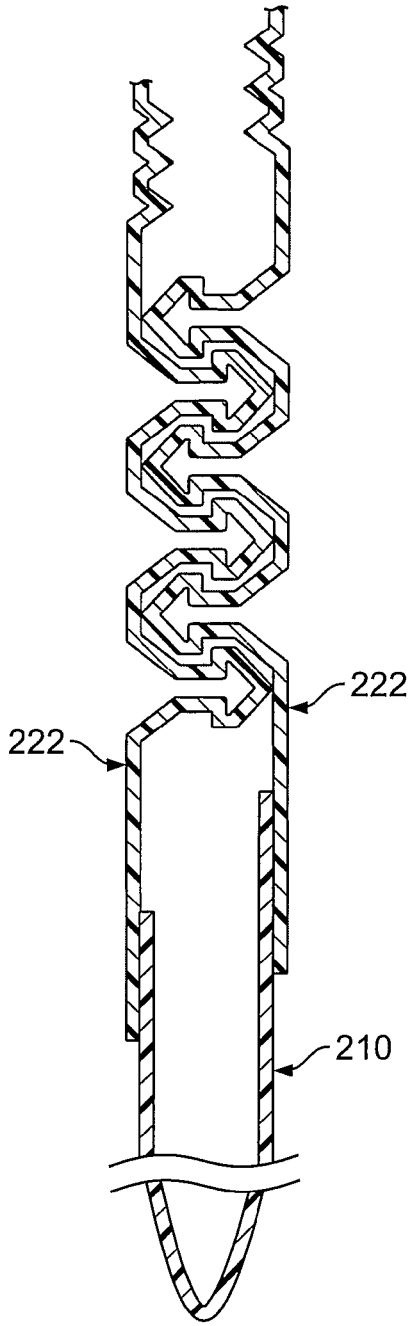

Turning now to FIGS. 9-10B, another reclosable pouch 210 includes a first pouch sidewall 212 opposing a second pouch sidewall 214 that together define an opening or mouth 216 into an interior space 218 of the reclosable pouch. Closure strips 222 are disposed in opposing positions on pouch sidewalls 212 and 214 coextensive with a mouth edge 220 of the pouch sidewalls to selectively engage and disengage with each other for alternatingly closing and opening the reclosable pouch.

Each closure strip 222 includes a plurality of elongate hollow-back interlocking male closure profiles 224 regularly spaced in parallel relation to each other and to the mouth edge 220. Although three male closure profiles 224 are shown in FIGS. 9-10B, more or fewer profiles could be used. Each male closure profile 224 includes a stem portion defined by a pair of spaced apart parallel shaft walls 226 extending from a pair of angled spaced apart transition walls 228 and a head portion defined by a head wall 230 extending across, and in one embodiment laterally beyond, the stem walls. An interconnecting wall 232 extends between adjacent transition walls 228 of adjacent male profiles 224. The shaft walls 226, transition walls 228, and head wall 230 of each male closure profile 224 define a hollow core or central space 234 therebetween and an opening 236 into the hollow core.

Each pair of adjacent male closure profiles 224 further defines an elongate female closure profile 238 therebetween. Each female closure profile 238 defines a channel having sidewalls defined by adjacent shaft walls 226 and transition walls 228 of the adjacent male closure profiles 224, the interconnecting wall 232 therebetween, and a barb wall portion 240 of the head wall 230. The female closure profile 238 is sized and configured to interlockingly accept the head portion of an opposing male profile 224 as best shown in FIG. 10B. When the closure strip 222 includes more than two male closure profiles 224, the male closure profiles may be spaced at a regularly repeating distance to facilitate interlocking of any two opposing closure elements. Alternatively, adjacent male closure profiles could be spaced at irregular intervals (not shown) in order to facilitate interlocking of opposing profiles at a predetermined spatial relationship.

Each closure strip 222 further includes an elongate flange 242 extending laterally from an outer transition wall 228 on an end male closure profile 224 and an elongate flange 244 extending laterally from an outer transition wall on an opposite end male closure profile. The flange 242 is disposed on one of the pouch sidewalls 212 or 214 such that the head portions of the male closure profiles 224 point toward the interior side of the pouch sidewall 212 or 214. The flange 242 may be attached to either the interior side or an exterior side of the pouch sidewalls 212, 214. Alternatively, the flange 242 may be formed integrally with the pouch sidewalls 212 or 214 (not shown). Each flange 244 may include at least one elongate grip rib 246 formed therein to facilitate gripping of the closure strip 222 by a user when opening and/or closing the reclosable pouch 210. The grip ribs 246 may have, for example, a saw tooth shaped profile as shown in FIG. 6, a V-shape, a U-shape, a rectangular shape, or any other shape sufficient to facilitate gripping of the closure strip 222 and combinations thereof. The entire closure strip 222 shown in FIGS. 9-10B has a constant thickness 't' throughout. Alternatively, some portions of the closure strip 222 may have a thickness greater than other portions. For example, the grip ribs 246 may be thickened portions of the end wall 244, or the head wall 230 could have a greater thickness to provide greater shape stability for the head portion. Other portions of the closure strip 222 may also have a different thickness for other structural and/or tactile aesthetic reasons.

The closure strip 222 on the pouch sidewall 212 is laterally offset from the closure strip on the on the pouch sidewall 214 such that a male closure profile 224 on one closure element is directly opposite a female closure profile 238 on the opposite closure element as shown in FIGS. 10A and 10B. To seal or close the mouth 216, the male closure profiles 224 of one closure strip 222 are urged into interlocking engagement within the opposing female closure profiles 238 of the opposing closure strip such that the barb wall portions 240 of the engaged closure profiles are snapped or urged past each other.

The closure strip 222 may be extruded, for example, by any sufficient extrusion technique known to those skilled in the art from any suitable thermoplastic material for providing a resealable or interlocking closure element. Other manufacturing techniques or materials that would form a suitable closure element 220 may also be used as described herein. In one embodiment, the closure strip 222 is extruded having an interlocking profile that is a single layer. In another embodiment, the closure strip 222 may be extruded having an interlocking profile that has two or more layers, and the layers may be the same or different materials.

The entire closure strip 222 is both elastically and resiliently deformable in a spring- or accordion-like manner in a lateral direction because the male closure profiles 224 have hollow cores 234 and openings 236. As a result, the closure strip 222 may feel softer to the user and provide a wider finger contact area in comparison to closure strip of a similar size having non-hollow back profiles. This resilient lateral deformability also helps facilitate pressing the male closure profiles 224 into the female closure profiles 238. The closure strip 222 also provides a relatively thin cross sectional area of material that may provide advantages for higher speed processing during production and may require less material than a closure strip having solid closure profiles of similar size.

Figure 11:
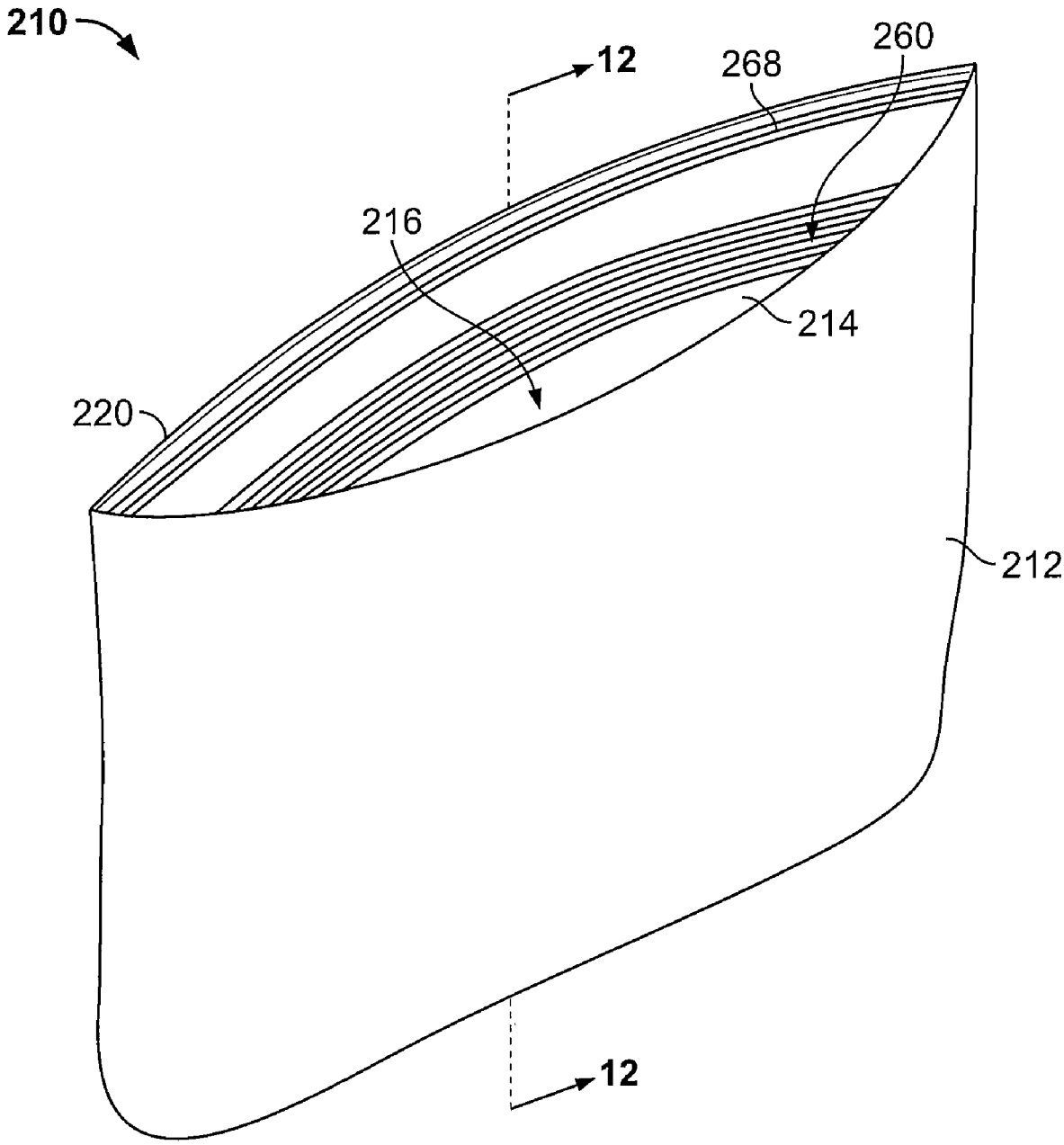
FIG. 11 is an isometric view of a reclosable pouch having hollow interlocking profiles according to yet one more aspect of the present invention.
Figure 12A:
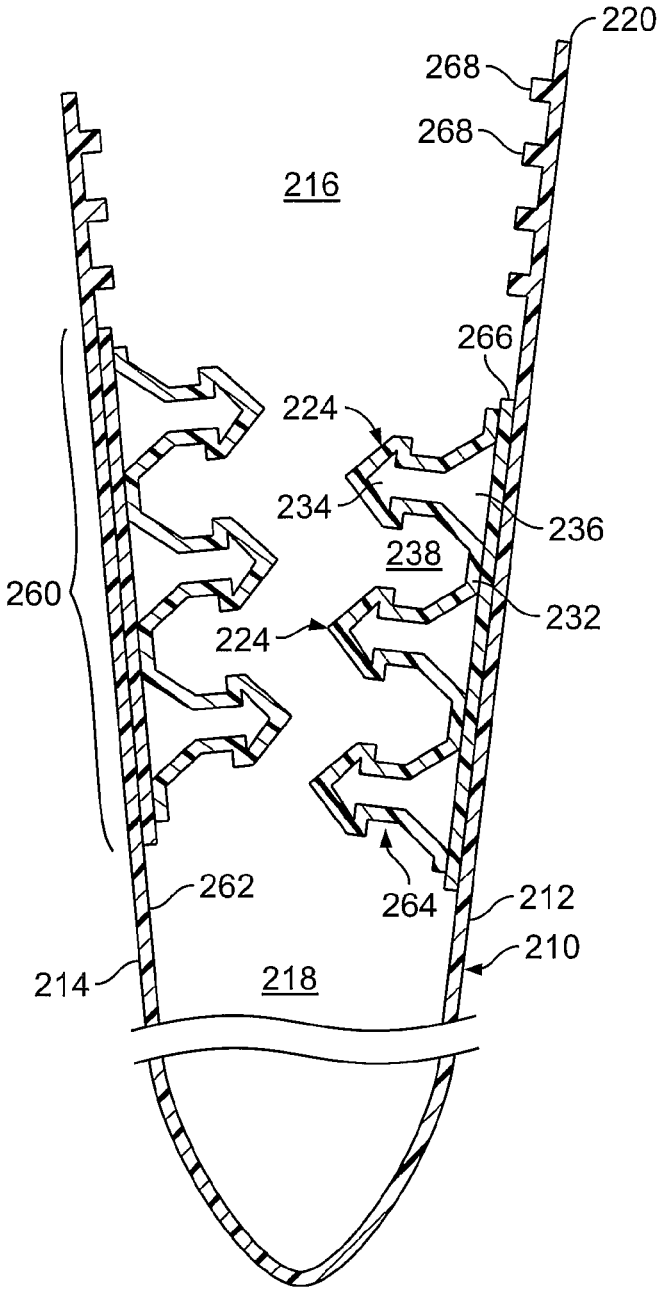
FIGS. 12A and 12B are fragmentary cross-sectional views taken generally along the lines 12-12 of FIG. 11 showing the reclosable pouch in an open position and occluded, respectively, with portions behind the plane of the cross-section omitted for purposes of clarity.
Figure 12B:
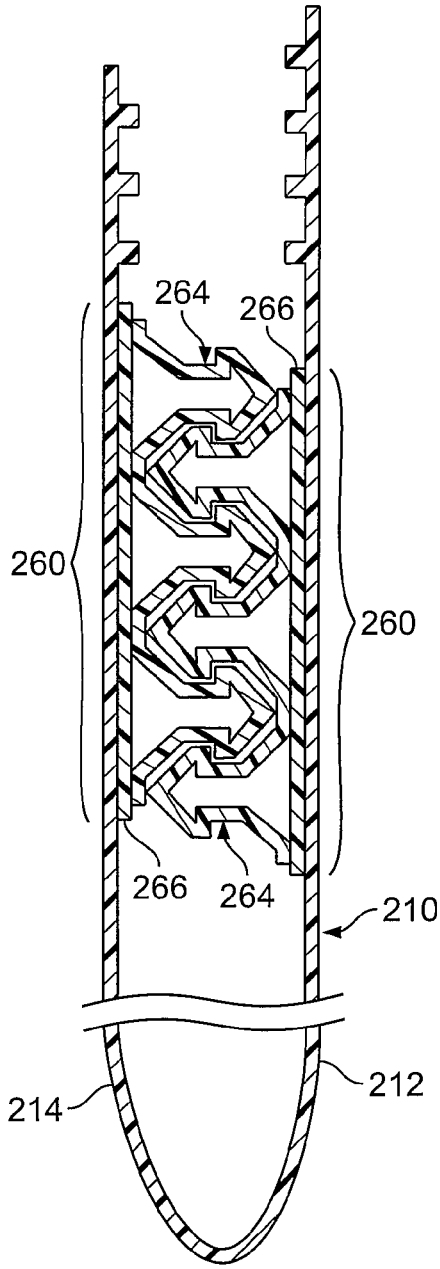
Figure 13:
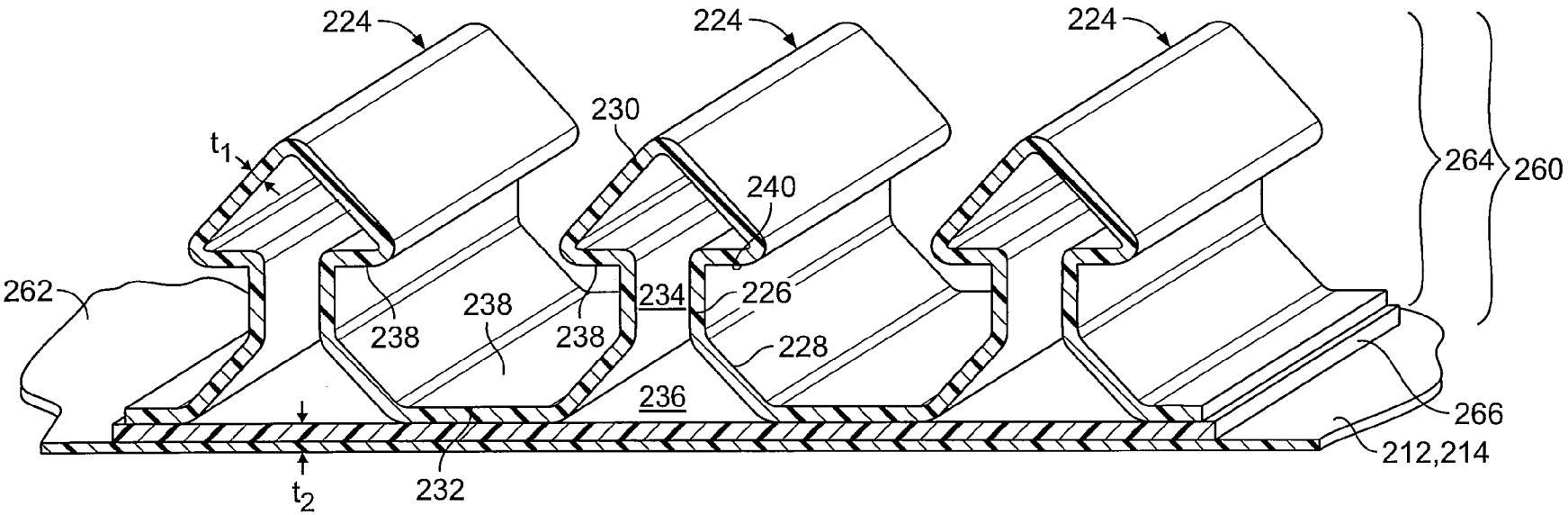
FIG. 13 is a fragmentary, enlarged, isometric view of a closure strip on the reclosable pouch of FIG. 11.

Referring now to FIGS. 11-13, another reclosable pouch 210 includes closure mechanisms 260 disposed in opposing relation on inside surfaces 262 of pouch sidewalls 212 and 214 proximate an opening 216. Each closure mechanism 260 includes a closure strip 264 and a base member 266. The closure strip 264 is substantially similar to the closure strip 222 of FIG. 10A, including elongate interlocking hollow-core male closure profiles 224 defining complementary elongate interlocking female closure profiles 238 therebetween, except that the flanges 242 and 244 are not included. The base member 266 extends laterally across openings 236 into hollow cores 234 of the male closure profiles 224 and is attached to interconnecting walls 232. As shown in FIG. 13, the closure strip 264 may have a constant thickness $t_1$ throughout, and the base member may have a constant thickness $t_2$ throughout. The thickness $t_1$ may be the same as or different than the thickness $t_2$. Alternatively, different portions of the closure strip 264 may have different thicknesses for structural and/or aesthetic reasons.

A base member 266 may be secured and/or separately extruded on to, for example, a like polymer to an inside surface 262 of each pouch sidewall 212 and 214 in an offset opposing relation such that the male closure profiles 224 on one closure mechanism 260 are opposite the female closure profiles 238 on the opposing closure mechanism. Such offset relation allows the reclosable pouch 210 to be sealed or closed along the mouth 216 by the opposing closure mechanisms 260 without undue distortion and/or wrinkling of the pouch sidewalls 212, 214 as shown in FIG. 12B.

Grip traction enhancers, such as elongate grip ridges 268, are located on the interior surface 262 of each pouch sidewall 212, 214 between a mouth edge 220 thereof and each closure mechanism 260. The grip ridges 268 provide enhanced traction for a user to grip the pouch sidewalls 212, 214 when opening and/or closing the reclosable pouch 210. Other traction enhancing formations, such as, for example, the grip ridges shown in FIG. 6, dimples, raised bumps, and/or a high friction surface strip, or a combination thereof, could also or alternatively be used to provide enhanced gripping traction.

Figure 14A:
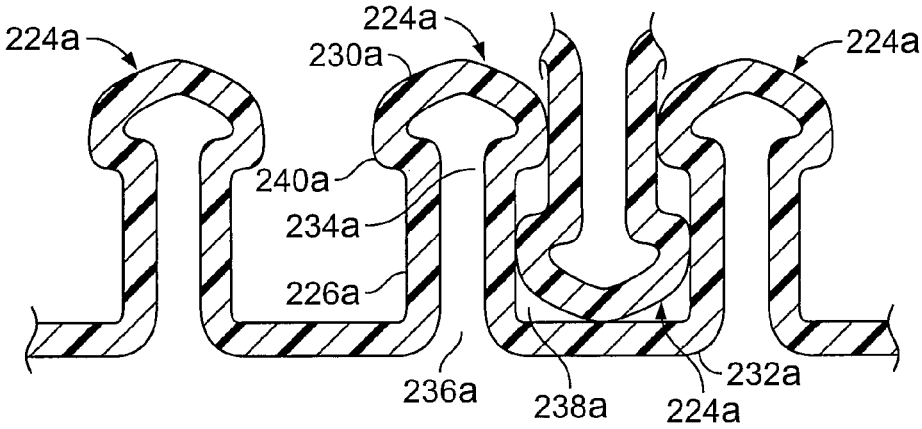
FIGS. 14A-14F are fragmentary, enlarged, cross-sectional views of various hollow closure profiles according to further aspects of the present invention.
Figure 14B:
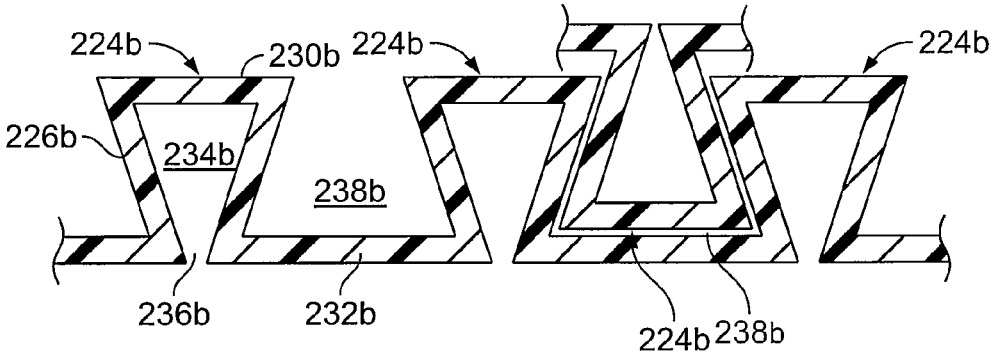
Figure 14C:
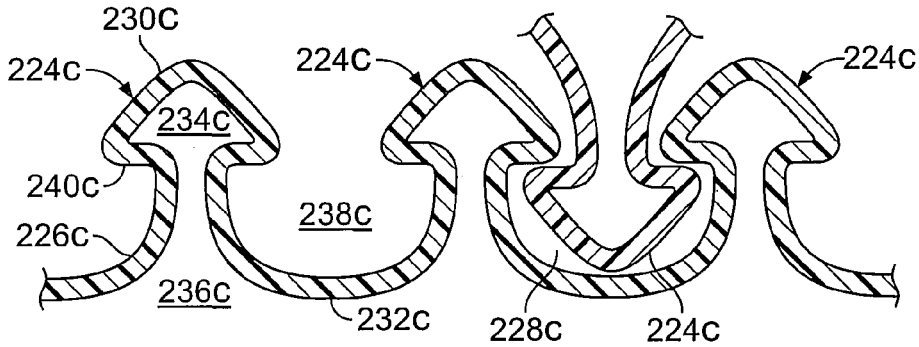
Figure 14D:
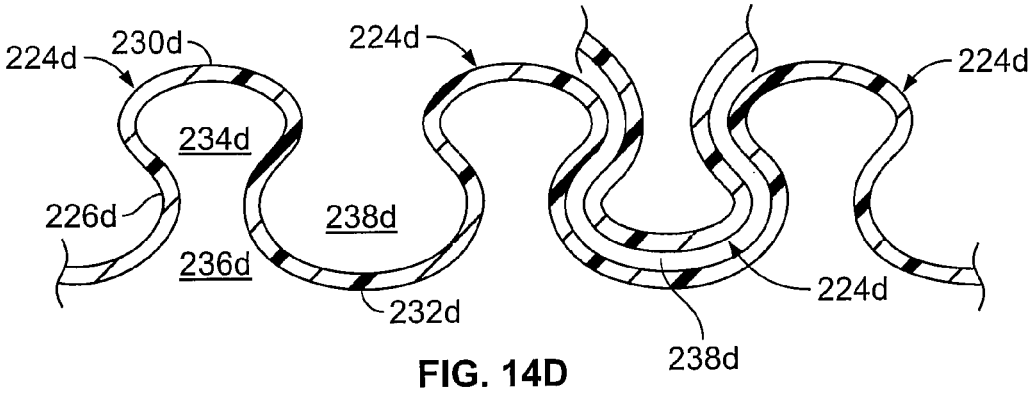
Figure 14E:
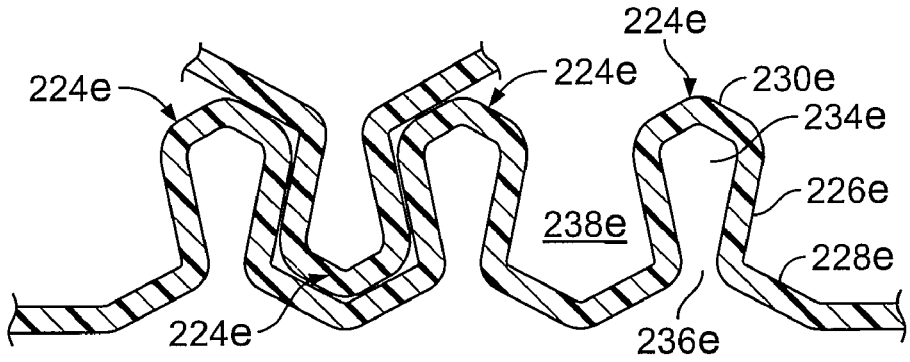
Figure 14F:
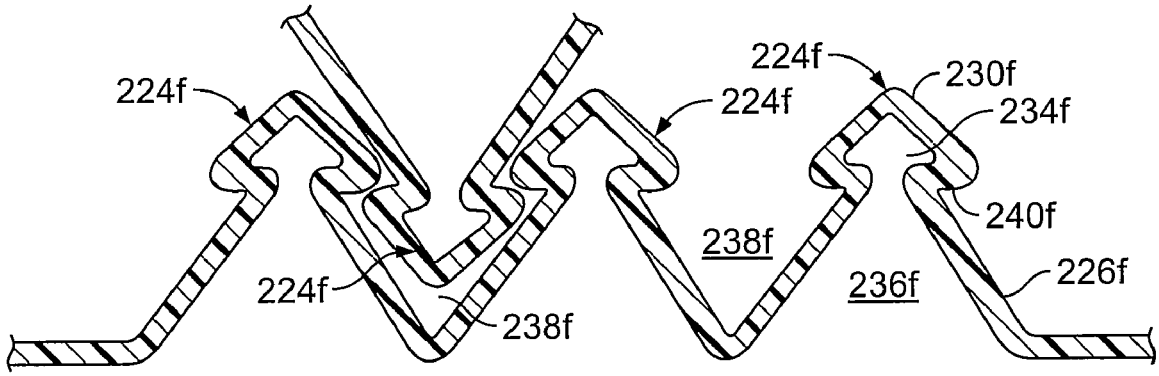

FIGS. 14A-14F show examples of different profiles 224*a*-224*f* for elongate hollow-core interlocking closure strips similar to closure strip 222 shown in FIG. 10A or closure strip 264 shown in FIG. 12A. In FIG. 14A, each of a plurality of male closure profiles 224*a* is generally arrow-shaped having a head wall 230*a* with a barb portion 240*a* defining a barbed head and parallel straight spaced apart shaft walls 226*a* connecting the head wall to interconnecting walls 232*a*. The shaft walls 226*a*, head wall 230*a*, interconnecting wall 232*a*, and barb portion 240*a* define a hollow core 234*a* and an opening 236*a* leading therein. In FIG. 14B, each of a plurality of male closure profiles 224*b* is generally triangularly shaped having cutback spaced apart shaft walls 226*b* and a head wall 230*b* defining a hollow core 234*b*. The shaft walls 226*b* and an interconnecting wall 232*b* of each pair of adjacent male closure profiles 224*b* define a complementary female closure profile 238*b* therebetween. In FIG. 14C, each of a plurality of male closure profiles 224*c* has a more rounded arrow shape than the male closure profiles 224*a* in FIG. 14A. In FIG. 14D, each male closure profiles 224*d* is defined by a generally continuously curved wall defining a rounded bulbous hollow-core ridge 234*d* with spaced apart cutback shaft wall portions 226*d* and an oversized headwall portion 230*d*. Adjacent male closure profiles 224*d* define a complementary female closure profile 238*d* therebetween. In FIG. 14E, each of a plurality of male closure profiles 224*e* includes spaced apart cutback shaft walls 226*e* and angled head walls 230*e* that define a hollow-core 234*e* and an opening 236*e*. Angled transition walls 228*e* extend between adjacent male closure profiles 224*e*, which also define a complementary female closure profile 238*e* therebetween. In FIG. 14F, each of a plurality of male closure profiles 224*f* includes a peaked head wall 230*f* with a barb portion 240*f* and outwardly slanted spaced apart shaft walls 226*f* defining a hollow-core 234*f*. Adjacent shaft walls 226*f* of adjacent male closure profiles connect directly to each other without a separate interconnecting base wall portion. Adjacent male closure profiles 224*f* define a complementary female closure profile 238*f* therebetween. This list of hollow-core interlocking profile examples is not exhaustive, and other hollow-core interlocking profiles having similar interlocking characteristics are also contemplated as being within the scope of the present invention.

Figure 15:
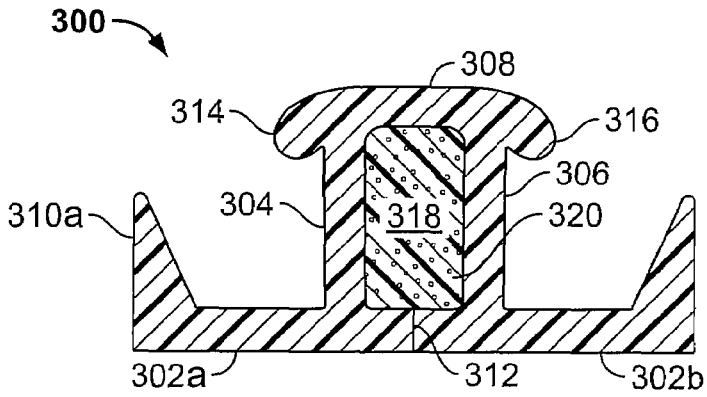
FIG. 15 is a cross-sectional view of a male closure element according to a further aspect of the present invention having a hollow core.
Figure 17:
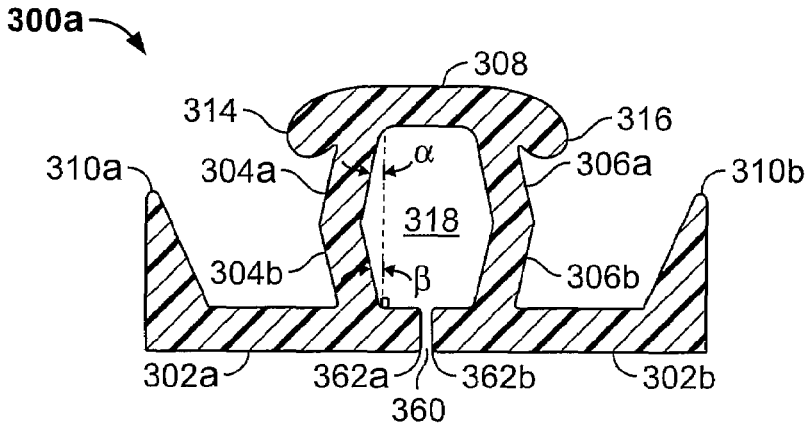
FIG. 17 is a cross-sectional view of an intermediate male closure element according to yet another aspect of the present invention immediately after being extruded from the die plate of FIG. 16.

Turning now to FIGS. 15 and 17, a male closure profile 300 of a hollow longitudinally elongate interlocking closure element, as seen in FIG. 15, includes a base wall 302, shaft walls 304, 306, head wall 308, and grip ridges 310*a*, 310*b*. The base wall 302 includes two laterally adjacent coplanar base wall portions 302*a* and 302*b* attached at a seam 312 disposed therebetween. The seam 312 is the location of a thermal weld or bond between the base wall portions 302*a* and 302*b*. Grip ridges 310*a*, 310*b* are located on opposite lateral ends of the base wall 302 for providing a surface for a user to grip when opening and/or closing a reclosable pouch (not shown). In another embodiment (not shown), either of both of the grip ridges 310*a*, 310*b* may be omitted. The shaft wall 304 extends substantially perpendicularly upwardly from the base wall portion 302*a* and is laterally spaced between the grip ridge 310*a* and the seam 312. The shaft wall 306 similarly extends perpendicularly upwardly from the base wall portion 302*b* and is laterally spaced between the seam 312 and the grip ridge 310*b*. In one example, the shaft walls 304 and 306 are spaced apart a distance sufficient to allow them to flex inwardly and nearly touch when being interlocked with a female closure element. The head wall 308 spans across the ends of shaft walls 304, 306 and forms male interlocking members, such as hooks 314 and 316, for interlocking engagement with the opposing female closure profile. The shaft walls 304 and 306, base wall 302, and the head wall 308 together define an enclosed hollow shaft core 318 having substantially parallel shaft walls. In one embodiment, the hook 314 is smaller than the hook 316 to provide a differential opening force when separated from a complimentary interlocking closure element in a manner well known in the art, and a structural support material, such as foam 320, is disposed inside the hollow shaft core 318. In another embodiment, the hooks 314 and 316 may be substantially the same size, and the hollow shaft core 318 may be substantially devoid of material.

The male profile 300 may be attached directly to a reclosable pouch sidewall or the male profile may be attached to an intermediate base strip (not shown) to form a closure strip for subsequent application to a reclosable pouch sidewall. In one embodiment, the male profile 300 having a hollow shaft core 318 may tend to provide a higher opening force to closing force ratio than a similarly sized solid core male profile when interlocked with a complimentary female profile because the shaft walls 304 and 306 can flex inwardly as the female interlocking closure element is urged over the head wall 308 and hooks 314, 316. For example, in one embodiment, the male profile 300 was extruded from a polymer material to have a final dimension of 0.123 inches wide by 72 mils thick, which resulted in a 0.36 pound closing force, an 8 pound external opening force, and a 10 pound internal opening force.

Figure 16:
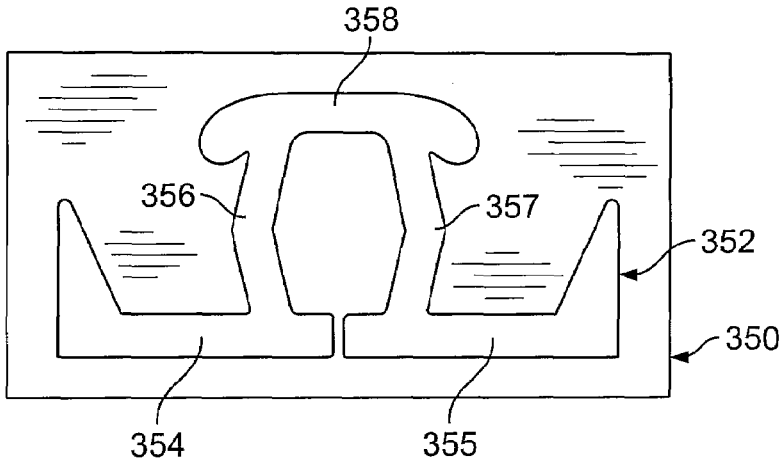
FIG. 16 is a front elevational view of a die plate according to one more aspect of the present invention for extruding the closure element of FIG. 15.

Illustratively, any of the closure elements disclosed herein may be extruded as a single layer or in multiple layers by any convenient extrusion process known to those skilled in the art, and, for example, from a thermoplastic material similar to that used for a pouch wall, or any other extrudable material suitable for forming an closure element having and elongate profile. The closure elements could also be formed in single or multiple layers by other suitable processes, such as by hand forming, molding, carving, etching, folding and crimping, aggregation, or accumulation of other materials, such as, for example, wax, rubber, metal, cloth, polymeric material, plastic, and/or any other suitable flexible material, and combinations thereof. For example, and referring now to FIGS. 15-17, extrudable material, such as, for example, a thermoplastic, may be extruded through a die plate 350 having an extrudate aperture 352, which is configured to form an intermediate male profile 300*a* for an elongate male closure element. The extrudate aperture 352 includes a first portion 354 configured to form a first base wall portion 302*a*, a second portion 355 configured to form a second base wall portion 302*b*, a third portion 356 configured to form a shaft wall 304, a fourth portion 357 configured to form a shaft wall 306, and a fifth portion 358 configured to form a head wall 308 and hooks 314, 316. The following illustration of the intermediate male profile 300*a* is equally applicable to the extrudate aperture 352 because in this embodiment the intermediate male profile has the same dimensions as the extrudate aperture immediately upon exiting the extrudate aperture.

The intermediate male profile 300*a* includes two laterally spaced base wall portions 302*a* and 302*b* that form a gap 360 between adjacent ends 362*a*, 362*b* of the base wall portions. The gap 360 in one embodiment is a size so that the die swell of the extrudate causes the ends 362*a* and 362*b* to fuse together shortly after exiting the extrudate aperture 352, thereby forming the enclosed hollow shaft core 318 and the seam 312 of the male profile 300 shown in FIG. 15. Alternatively, the gap 360 may be a size so that the ends 362*a*, 362*b* do not fuse together. Having the ends 362*a* and 362*b* fused together at the seam 312 may increase the flexural resiliency of shaft walls 304 and 306 by, for example, providing mechanical separation between the shaft walls along the base wall 302 and/or by entrapping air within the enclosed hollow shaft core 318. Each shaft wall 304, 306 of the intermediate male profile 300*a* is outwardly bowed and includes an upper shaft wall portion 304*a*, 306*a* that is angularly displaced from a lower shaft wall portion 304*b*, 306*b*, respectively. Each of the upper and lower shaft wall portions 304*a*, 304*b*, 306*a*, 306*b* are angularly displaced outwardly from a perpendicular to the respective base wall portions 302*a*, 302*b* an angle $\alpha$ or $\beta$, respectively, sufficient to allow the upper and lower shaft wall portions to shrink inwardly while the extrudate is cooling so that the shaft walls 304 and 306 are substantially perpendicular to the base wall 302 when the closure element is fully cooled. The intermediate male profile 300*a* further includes grip ridges 310*a* and 310*b* and head wall 308, defining hooks 314, 316, all similar to, but larger than the same structures on the final male profile 300.

In one embodiment, the die plate 350 is configured to provide for a wall thickness of the base wall portions 302*a* and 302*b* of between about 0.1 inches and about 2 inches, or between about 0.2 inches and 1 inch, or about 0.55 inches. The die plate 350 is also configured to provide for a gap 360 between about 0.001 inches and about 1 inches, or between about 0.005 inches and about 0.5 inches, or about 0.015 inches. The die plate 350 is also configured to provide for an overall width of the base wall portions and the gap between about 0.2 inches and about 3 inches, or between about 0.5 inches and about 1.5 inches, or about 0.72 inches. The die plate 350 is also configured to provide for a total height of the profile 300*a* between about 0.1 inches and about 1.5 inches, or between about 0.2 inches and about 0.75 inches, or about 0.335 inches. The die plate 350 is also configured to provide for wall thickness of the shaft walls 304 and 306 between about 0.01 inches and 0.5 inches, or about between about 0.03 inches and about 0.1 inches, or about 0.0459 inches thick. The die plate 350 is also configured to provide for an initial minimum space between the shaft walls between about 0.01 inches and about 0.5 inches, or between about 0.1 inches and about 0.2 inches, or about 0.13 inches. The die plate 350 is also configured to provide for a wall thickness of the head wall 308 between about 0.01 inches and 0.3 inches thick, or between about 0.03 inches and about 0.1 inches, or about 0.045 inches thick along a centerline thereof. The die plate 350 is also configured to provide for both $\alpha$ and $\beta$ between about 0° and 30°, or between about 5° and 15°, or about 10° immediately upon exiting the extrudate aperture 352. Alternatively, the angles α and/or β may be larger or smaller to form final shaft walls that are bowed outwardly or inwardly, and other dimensions may be used to form differently configured closures. The intermediate male profile 300*a* is then drawn and cooled after being extruded to form the male profile 300 shown in FIG. 15. Alternatively, the intermediate profile 300*a* may be drawn and cooled in a manner to form a final closure element profile (not shown) with outwardly bowed or inwardly bowed shaft walls and with or without maintaining a gap between the ends of the base wall portions.

In other embodiments of the present invention a closure mechanism for a reclosable pouch is provided where the closure mechanism has at least one elongate male closure profile and at least one elongate female closure profile. The elongate male closure profile in one embodiment includes at least one hollow core shaft and at least one male interlocking member disposed on the shaft. In yet another embodiment the female closure profile includes at least one hollow core channel wall and at least one female interlocking member. Illustratively, a closure mechanism includes at least one elongate male closure profile with at least one hollow core shaft and at least one elongate female closure profile with solid channel walls. Alternatively, a closure mechanism includes at least one elongate female closure profile with at least one hollow core channel wall and at least one elongate male closure profile with solid walls.

In other embodiments, at least one male interlocking member is configured to engage and interlock with at least one female interlocking member; and/or at least one female interlocking member is configured to engage and interlock with at least one male interlocking members.

A male closure profile of the present invention may also have at least one ridge having an enclosed hollow core disposed adjacent to a shaft of the male closure profile.

A closure mechanism of the present invention may also include a male closure profile that is disposed on one sidewall of a reclosable pouch, and on the opposite side of the reclosable pouch a female closure profile is disposed on the other sidewall of the reclosable pouch. The male interlocking member and the female interlocking member may be independently configured to engage and/or interlock each other. The male and/or female closure profile may be secured to the sidewall and/or separately extruded on to the sidewall.

In yet another embodiment, a closure mechanism has at least one base member attached to at least one side of the male closure profile opposite the male interlocking member and defines at least one hollow core shaft. Alternately, the closure mechanism has at least one base member attached to at least one side of the female closure profile opposite the female interlocking member and defines at least one hollow core cannel wall.

A female interlocking member of the present invention may have at least one hook or barb extending from at least one wall of a hollow core channel wall, and may be configured to engage and/or interlock with a male interlocking member including, for example, engaging and/or interlocking at least one male hook or barb of the male interlocking member. In yet another embodiment, the female interlocking member has two female barbs that may or may not be spaced apart extending from the hollow core channel wall. The hooks or bards may be independently configured to independently engage and/or interlock with a male interlocking member including, for example, engaging and/or interlocking at least one male hook or barb of the male interlocking member.

A male interlocking member of the present invention may also have at least one hook or barb extending from at least one hollow core shaft of the male interlocking member, and is configured to engage and/or interlock with a female interlocking member including, for example, engaging and/or interlocking at least one female hook or barb of the female interlocking member.

Illustratively, a closure mechanism of the present invention may include a male interlocking member having a first male barb and a second male barb; and a female interlocking member having a first female barb and a second female barb. The first male barb and second male barb may be independently configured to independently interlock and/or engage the first female barb and/or the second female barb; and the first female barb and second female barb may be independently configured to independently interlock and/or engage the first male barb and/or the second male barb. In a fully interlocked configuration, at least one of the male barbs and at least one of the female bars are interlocked and engaged.

In another embodiment, a closure mechanism has a male interlocking member and/or a female interlocking member that has at least one wall having at least one pleat. The pleats may, for example, assist in improving the interaction and/or engagement of the male and female interlocking members, and/or may improve the seal of the closure mechanism when the male and female interlocking members are engaged in an interlocking position.

In other embodiments of the present invention, an elongate male closure profile is provided having at least one shaft that has a first shaft wall laterally spaced from a second shaft wall, a hollow core disposed between the first shaft wall and the second shaft wall, a base end, and a distal end opposite the base end; and at least one male interlocking member proximate the distal end of the shaft. In one embodiment, the shaft walls converge proximate the distal end.

In another embodiment, a male closure profile has at least one ridge having a hollow core laterally adjacent a base end of a shaft and a flange extended laterally outwardly from the ridge opposite the shaft. The ridge may include a first ridge wall extended angularly upwardly from the base end of a shaft wall and a second ridge wall extended angularly downwardly from an end of the first ridge wall opposite the base end of the shaft wall.

A male closure profile of the present invention may also have at least one backing member disposed across a base end of a first shaft wall and a second shaft wall defining an enclosed hollow core between the first shaft wall and the second shaft wall.

In yet other embodiments of the present invention, an elongate female closure profile is provided having a channel member that has at least one interior wall defining an interior of the channel and a female interlocking member; and at least one exterior wall laterally spaced from the interior wall. At least one of the interior walls and at least one of the exterior walls may also define a hollow core therebetween. The channel member may have any number of walls to define any number of shapes and/or configurations so long as the channel can be configured to interlock and/or engage an interlocking member, for example, a male interlocking member. Illustratively, the channel may be bowl-shaped, U-shaped, V-shaped, W-shaped, and/or concave shaped, and combinations thereof.

In yet other embodiments, a female closure profile has an interior wall and an exterior wall that meet or converge proximate a distal end thereof.

In still other embodiments, a female closure may also have a flange extending laterally from a base end of an exterior wall.

In another embodiment, a female closure profile has an interior wall having a first interior channel wall, a second interior channel wall, and a base interior channel wall extending laterally from a base end of the first interior channel wall to a base end of the second interior channel wall.

A female closure profile in one embodiment provides a female interlocking member having at least one female barb extending into a channel from an interior wall near the distal end thereof. In one embodiment, the female interlocking member has at least two female barbs extending into the channel from the interior wall between a distal end of the interior wall and a base end of the interior wall opposite the distal end.

In yet another embodiment, a female closure profile has at least one backing member disposed across an interior wall and an exterior wall opposite the distal end of where the interior wall and exterior wall converge.

A female interlocking member of the present invention may have a female closure element configured to interlock and/or engage a complementary male interlocking member. In yet another embodiment, a male interlocking member of a male closure element is configured to engage a complementary female interlocking member.

In embodiments with multiple male closure profiles and/or multiple elongate male closure profiles with multiple shafts and/or male interlocking members, each shaft and male interlocking member may be independently shaped and/or configured.

In embodiments with multiple elongate female closure profiles and/or multiple elongate female closure profiles with multiple channel members and/or exterior walls the shape and/or configuration of each channel and/or exterior wall can be independently shaped and/or configured.

A male or female hook or barb useful in the present invention can be of any shape and/or size as long as it can be configured to engage and/or interlock with a corresponding male, or female interlocking member on a closure mechanism by, for example, catching another hook or barb of the corresponding male or female interlocking member. Additionally, single or multiple hooks or barbs can be used on a male or female interlocking member. Illustratively, a hook or barb can be a protrusion; a bump; a convex shape; a sharp point projecting in reverse direction to a main axis, such as an arrow; a curved or sharply bent point; and/or a projection that is not necessarily sharp or pointed, but has an acute or obtuse end, such as a square, rectangle, blunt or rounded tip. Combinations of hooks and barbs can be used in the present invention.

The reclosable pouches, closure elements, and/or associated structures and profiles of the present invention may be extruded as a single layer or as two or more layers, and different portions may be single or multiple layers. Different layers may be the same or different materials. For example, different layers may be co-extruded and bonded at the same time, or the different layers may be individually extruded and bonded at different times.

The hollow portion of either the hollow core shaft or the hollow core channel may also include material to provide additional structural support to the male or female closure profile. Illustratively, the material may be a foam, such as, for example, a polymer, and/or a foamable resin. A polymer useful in the present invention includes, for example, an alkylene aromatic polymer, a rubber-modified alkylene aromatic polymer, a hydrogenated alkylene aromatic polymer and copolymers, an alpha-olefin homopolymer, a linear low density polyethylene, a copolymer of ethylene with a copolymerizable, a mono-ethylenically unsaturated monomer; a copolymer of propylene with a copolymerizable, a mono-ethylenically unsaturated monomer; a copolymer of ethylene with an alkane, and a thermoplastic polyurethanes, thermoplastic elastomers (TPE's), and combinations thereof. Other material useful in the present invention to provide structural support includes the material described in U.S. Pat. No. 6,844,055. Still other material useful in the present invention to provide structural support includes the material described in U.S. Pat. No. 3,723,586. Yet other material useful in the present invention to provide structural support includes the material described in U.S. Pat. No. 4,824,720. Other material useful in the present invention to provide structural support includes the material described in U.S. Pat. No. 6,844,055. Techniques useful in preparing a foamable composition include those described in U.S. Pat. No. 5,817,705. Other techniques useful in preparing a foamable composition include those described in U.S. Pat. No. 4,323,528. Combinations of the above materials to provide additional structural support may also be used in the present invention. Other additives, such as, for example, a stabilizer, a filler, and/or a reinforcing material; a blowing agent; a nucleating agent; an extrusion aid; an antioxidant; a flame retardant; a colorant; and/or a pigment; and combinations thereof, may also be incorporated into the materials to provide structural support.

Reclosable pouches, closure strips, closure elements, closure profiles, and/or grip ridges useful in the present invention can be made by various techniques known to those skilled in the art including those described in, for example, Geiger, et al., U.S. Pat. No. 4,755,248. Other useful techniques to make reclosable pouches, closure strips, closure elements, closure profiles, and/or grip ridges of the present invention include those described in, for example, Zieke et al., U.S. Pat. No. 4,741,789. Other useful techniques to make reclosable pouches, closure strips, closure elements, closure profiles, and/or grip ridges of the present invention include those described in, for example, Porchia et al., U.S. Pat. No. 5,012,561. Another technique for making reclosable pouches, closure strips, closure elements, closure profiles, and/or grip ridges of the present invention include those described in, for example, Pawloski et al., U.S. Patent Application Publication No. 2003/0236158. The reclosable pouches, closure strips, closure elements, closure profiles, and/or grip ridges of the present invention may also be made by the process disclosed in Forman U.S. Pat. No. 5,944,425. Additional examples of making a reclosable pouch, closure strips, closure elements, and/or grip ridges as described herein include, for example, a cast post-applied process, a cast integral process, a hybrid of the cast post-applied and cast integral processes, a water bath extrusion process for extruding the closure mechanisms combined with post application of the closure mechanisms to a reclosable pouch sidewall film using lamination techniques in conjunction with a hot knife sealer process, and/or a blown process.

Illustratively, a reclosable pouch wall of the present invention can be made of any flexible material suitable for packaging a sample, article, and/or substance, including, for example, any suitable thermoplastic film. A flexible material useful in the present invention includes, for example, polyethylene (for example, low density polyethylene, and linear low density polyethylene), substantially linear copolymers of ethylene and a $C_3$-$C_8$ alpha-olefin, polypropylene, polyvinylidene chloride, polyvinyl chloride, vinyl, and/or other polymers, in single or multiple layer, and combinations thereof. Additionally, the reclosable pouch wall can be constructed of any flexible material including, for example, paper and/or metal, including, for example, aluminum foil or sheets. The flexible material may be transparent or semi-transparent (to permit viewing of the sample, article, and/or substance in the reclosable pouch), translucent, lucent, clear, and/or opaque, at least in part, depending on the application in which the reclosable pouch will be utilized.

Two or more surfaces described herein may be attached together in a permanent or non-permanent manner by any fastening, securing, and/or joining techniques known to those skilled in the art. Examples include mechanically, chemically, and/or heat fastening, securing, and/or joining together two or more surfaces of a metal, a plastic, a polymer, a glass, a rubber, a paper, and/or a ceramic, and combinations thereof. A chemical agent useful in the present invention to fasten, secure, and/or join two or more surfaces includes, for example, an adhesion promoter, a binding agent (for example, a cyanoacrylate adhesive, or an epoxy putty), a bonding agent (for example, a hot melt adhesive), a crosslinking agent, a curing agent (for example, a UV light curing adhesive), a fixative agent, a sticking agent, and/or a vulcanizing agent, and combinations thereof. Exemplary chemical agents useful in the present invention include those described in, for example, The Handbook of Industrial Chemical Additives—2nd Edition, Gower Publishing Limited (Mar. 28, 1998). Additional examples of chemical agents useful in the present invention include those described in the Merck Index, Thirteenth Edition, John Wiley & Sons, 13th edition (October 2001). Heat fastening, securing, and/or joining techniques useful in the present invention include, for example, ultrasound, heat or sonic staking, and/or laser welding or joining techniques. Mechanical techniques useful in the present invention, include, for example, the use of tabs, protrusions, clamps, fasteners, ties, fastening strips (for example, Velcro®), adhesive tape (for example, two sided tape), rivets, soldering, brazing, and/or welding, and combinations thereof. Alternatively, a surface of polymer, for example, may be extruded directly on to another surface (for example, a like polymer) capable of binding to the polymer. Combinations of the above fastening, securing, and/or joining techniques and agents can be used in the present invention.

INDUSTRIAL APPLICABILITY

The present invention provides apparatuses, methods, kits, and combinations useful for opening and/or closing a reclosable pouch. For example, the reclosable pouches, closure strips, closure elements, grip ridges, and profiles disclosed herein may have specific applicability for use on reclosable thermoplastic pouches, such as the pouches frequently used by consumers to store food and other items. The reclosable pouches, closure strips, closure elements, grip ridges, and profiles disclosed herein may also be used on other container and fastener applications and/or for other uses. A benefit of the hollow and pleated profiles disclosed herein is that they generally require less material to make; have a softer and wider tactile feel to a consumer; are easier to engage and seal because, for example, the overall amount of material may be uniform throughout the profile; can be structurally taller and at the same time use less material than similar solid or semi-solid profiles; require less cooling during manufacture compared to solid profiles, allowing, for example, higher production speeds while reducing energy costs; and have increased lateral deformability or stretchiness than similarly sized solid profiles. The reclosable pouches, closure strips, closure elements, grip ridges, and profiles disclosed herein may also be readily adapted for use with a slider closure mechanism.

The invention has been described in an illustrative manner, and it is to be understood that the terminology used is intended to be in the nature of description rather than of limitation. All patents and other references cited herein are incorporated by reference in their entirety. Many modifications, equivalents, and variations of the present invention are possible in light of the above teachings, therefore, it is to be understood that within the scope of the appended claims, the invention may be practiced other than as specifically described.

We claim:

1. A reclosable pouch comprising:

opposing first and second sidewalls defining a mouth of the pouch;

a first closure element disposed along the first sidewall adjacent to and generally coextensive with the mouth and having a first elongate male interlocking profile; and a second closure element disposed along the second sidewall opposite the first closure element and having second and third elongate male interlocking profiles;

wherein each male interlocking profile includes a male interlocking member disposed on a hollow shaft and wherein each male interlocking profile comprises an opening into the hollow shaft from an exterior of the pouch and is disposed opposite the male interlocking member and between a first shaft wall and a second shaft wall;

a flange portion extending from at least one of the male interlocking profiles; and a plurality of grip ridges formed in the flange portion and disposed on one side of the respective male interlocking profile, wherein the grip ridges have a pleated cross-sectional profile, wherein the second and third male interlocking profiles further define an elongate female interlocking profile therebetween such that the first male profile releasably interlocks into the female interlocking profile.

2. The reclosable pouch of claim 1, wherein the first closure element further comprises a fourth elongate male interlocking profile having a male interlocking member disposed on a hollow shaft, wherein the first and fourth male interlocking profiles further define a second elongate female interlocking profile, and wherein one of the second or third male interlocking profiles releasably interlocks into the second female interlocking profile.

3. The reclosable pouch of claim 1, further comprising at least one base member interposed between one of the first or second closure elements and the respective first or second sidewall and disposed at least partly across at least one of the openings.

4. A closure strip, comprising:

a plurality of spaced male closure elements, wherein each male closure element has an elongate male interlocking profile including a male interlocking member disposed proximate a distal end of a shaft having a hollow core, and wherein a pair of adjacent male closure elements defines a substantially complementary elongate female closure element therebetween;

a flange portion extending laterally from a base end of the shaft of one of the male closure elements; and a plurality of grip ridges formed in the flange portion, wherein the grip ridges have a pleated cross-sectional profile and the pleated cross-sectional profile has a different shape than the shape of the male interlocking profile, and wherein the plurality of grip ridges is disposed between the base end of the shaft and an outer end of the flange portion.

5. The closure strip of claim 4, wherein at least one of the male closure elements has a substantially constant profile thickness.

6. The closure strip of claim 5, wherein at least one male interlocking profile further comprises an opening into the hollow core through an end of the shaft opposite the male interlocking member.

7. The closure strip of claim 6, wherein each adjacent pair of make closure elements is contiguous.

8. The closure strip of claim 4, wherein at least one of the male interlocking profiles has a substantially constant profile thickness.

9. The closure strip of claim 8, wherein each male interlocking profile is resiliently deformable in a substantially transverse direction.

10. The closure strip of claim 9, wherein the closure profile comprises a polymeric material.

11. The closure strip of claim 4, wherein the first shaft wall and the second shaft wall of each male interlocking profile are arcuate.

12. The closure strip of claim 11, wherein the first shaft wall and the second shaft wall of each male interlocking profile are bowed inwardly.

13. The closure strip of claim 4, further comprising an elongate base member at least partly enclosing at least one of the hollow cores.

14. The closure strip of claim 4, wherein the grip ridges have a substantially constant profile thickness.

15. A reclosable pouch comprising:

opposing first and second sidewalls defining a mouth of the pouch;

a first closure element disposed along the first sidewall adjacent to and generally coextensive with the mouth, wherein the first closure element includes a first elongate male interlocking profile adjacent to a second male interlocking profile, wherein each male interlocking profile includes a first shaft wall spaced from a second shaft wall and a male interlocking member disposed across a distal end of the shaft walls, and wherein the first male interlocking profile and the second male interlocking profile define a female interlocking profile therebetween configured to interlockingly accept an opposing interlocking profile along the second sidewall;

a flange portion extending laterally from a base end of one of the first and second shaft walls of one of the first and second male interlocking profiles; and a plurality of grip ridges formed in the flange portion between the respective shaft wall and an outer end of the flange, wherein the grip ridges have a pleated cross-sectional profile different from the respective male interlocking profile.

16. The reclosable pouch of claim 15, wherein the pleated cross sectional profile has a first portion and a second portion angularly disposed from the first portion.

17. The reclosable pouch of claim 16, wherein the pleated cross sectional profile is an asymmetrical saw tooth shape.

18. The reclosable pouch of claim 15, wherein the flange portion includes a hook disposed along the outer end thereof angled toward the first and second male interlocking profiles to provide additional gripping structure.

19. A reclosable pouch comprising:

opposing first and second sidewalls defining a mouth of the pouch;

a first closure element disposed along the first sidewall adjacent to and generally coextensive with the mouth, wherein the first closure element includes a first elongate male interlocking profile adjacent to a second male interlocking profile, wherein each male interlocking profile includes a first shaft wall spaced from a second shaft wall and a male interlocking member disposed across a distal end of the shaft walls, and wherein the first male interlocking profile and the second male interlocking profile define a female interlocking profile therebetween configured to interlockingly accept an opposing interlocking profile along the second sidewall;

a flange portion extending laterally from a base end or one of the first and second shaft walls of one of the first and second male interlocking profiles, wherein the flange portion includes a hook disposed along the outer end thereof having a free end angled toward the first and second male interlocking profiles to provide additional gripping structure; and a plurality of grip ridges formed in the flange portion between the respective shaft wall and an outer end of the flange, wherein the grip ridges have a pleated cross-sectional profile that is a different shape from the hook.

20. A reclosable pouch comprising:

opposing first and second sidewalls defining a mouth of the pouch;

a first closure element disposed along the first sidewall adjacent to and generally coextensive with the mouth, wherein the first closure element includes a first elongate male interlocking profile adjacent to a second male interlocking profile, wherein each male interlocking profile includes a first shaft wall spaced from a second shaft wall and a male interlocking member disposed across a distal end of the shaft walls, and wherein the first male interlocking profile and the second male interlocking profile define a female interlocking profile therebetween configured to interlockingly accept an opposing interlocking profile along the second sidewall;

a flange portion extending laterally from a base end of one of the first and second shaft walls of one of the first and second male interlocking profiles; and a plurality of grip ridges formed in the flange portion between the respective shaft wall and an outer end of the flange, wherein the grip ridges have a pleated cross-sectional profile that has a first portion and a second portion angularly disposed from the first portion and wherein the pleated cross sectional profile is an asymmetrical saw tooth shape.

* * * * *

UNITED STATES PATENT AND TRADEMARK OFFICE

CERTIFICATE OF CORRECTION

PATENT NO. : 7,585,111 B2
APPLICATION NO. : 11/047013
DATED : September 8, 2009
INVENTOR(S) : Robert R. Turvey It is certified that error appears in the above-identified patent and that said Letters Patent is hereby corrected as shown below:

Column 19, Line 9 claim 7: replace “make” with --male--

Column 20, Line 20 claim 19: replace “or” with --of--

Signed and Sealed this

Ninth Day of November, 2010

David J. Kappos

David J. Kappos
*Director of the United States Patent and Trademark Office*